United States Patent [19]

Buan et al.

[11] Patent Number: 4,945,831

[45] Date of Patent: Aug. 7, 1990

[54] INK TRAY DRIVE

[75] Inventors: Danilo P. Buan, Easton, Conn.; Arnold T. Eventoff, Pleasantville, N.Y.

[73] Assignee: Pitney Bowes Inc., Stamford, Conn.

[21] Appl. No.: 291,096

[22] Filed: Dec. 28, 1988

[51] Int. Cl.[5] ..... B41F 1/42

[52] U.S. Cl. ..... 101/340; 101/366

[58] Field of Search ..... 101/101, 103, 335, 338, 101/359, 366, 340–343; 74/53

[56] References Cited

U.S. PATENT DOCUMENTS

| | | | |
|---|---|---|---|
| 2,756,674 | 7/1956 | Riecer et al. | 101/301 |
| 3,791,293 | 2/1974 | Rastorguyeff et al. . | |
| 4,277,791 | 7/1981 | Clary . | |
| 4,523,889 | 6/1985 | Orii | 74/53 |
| 4,579,054 | 4/1986 | Buan et al. . | |
| 4,665,821 | 5/1987 | Harry et al. . | |

FOREIGN PATENT DOCUMENTS

| | | | |
|---|---|---|---|
| 1219501 | 6/1966 | Fed. Rep. of Germany | 101/366 |
| 2074097 | 10/1981 | United Kingdom | 101/366 |

*Primary Examiner*—J. Reed Fisher

*Attorney, Agent, or Firm*—Charles G. Parks, Jr.; David E. Pitchenik; Melvin J. Scolnick

[57] ABSTRACT

An inker module for a high speed mailing machine is disclosed. The inker module includes a drive for moving an ink pad horizontally and vertically from a horizontal home position to a horizontal inking position in which the ink pad is tamped against a printing device which imprints postage indicia. The drive includes a single drive motor, cam wheels and links which cooperate to move the ink pad in the two directions. An ink pump is provided to pump ink to the ink pad each time that the ink pad is tamped against the printing device. The drive includes a further link to actuate the pump from the same motor. A platten device and its drive are disposed adjacent the ink pad drive to tamp an envelope or tape against the printing device in timed relation to movement of the ink pad.

9 Claims, 20 Drawing Sheets

(a)
Horizontal Tray Disp. (in.)
tx2=.0641
tx3=.9886
tx4=.1630
(b)
Tray Height (in)
tyr2=.0556
tyr6=.0773
tyr7=.0867
tyr9=.1075
(c)
Camshaft Disp. (Deg.)
tc1=.0321
tc2=.0499
tc3=.0638
tc8=.0992
tc9=.1131
tc10=.131
Time (Sec)

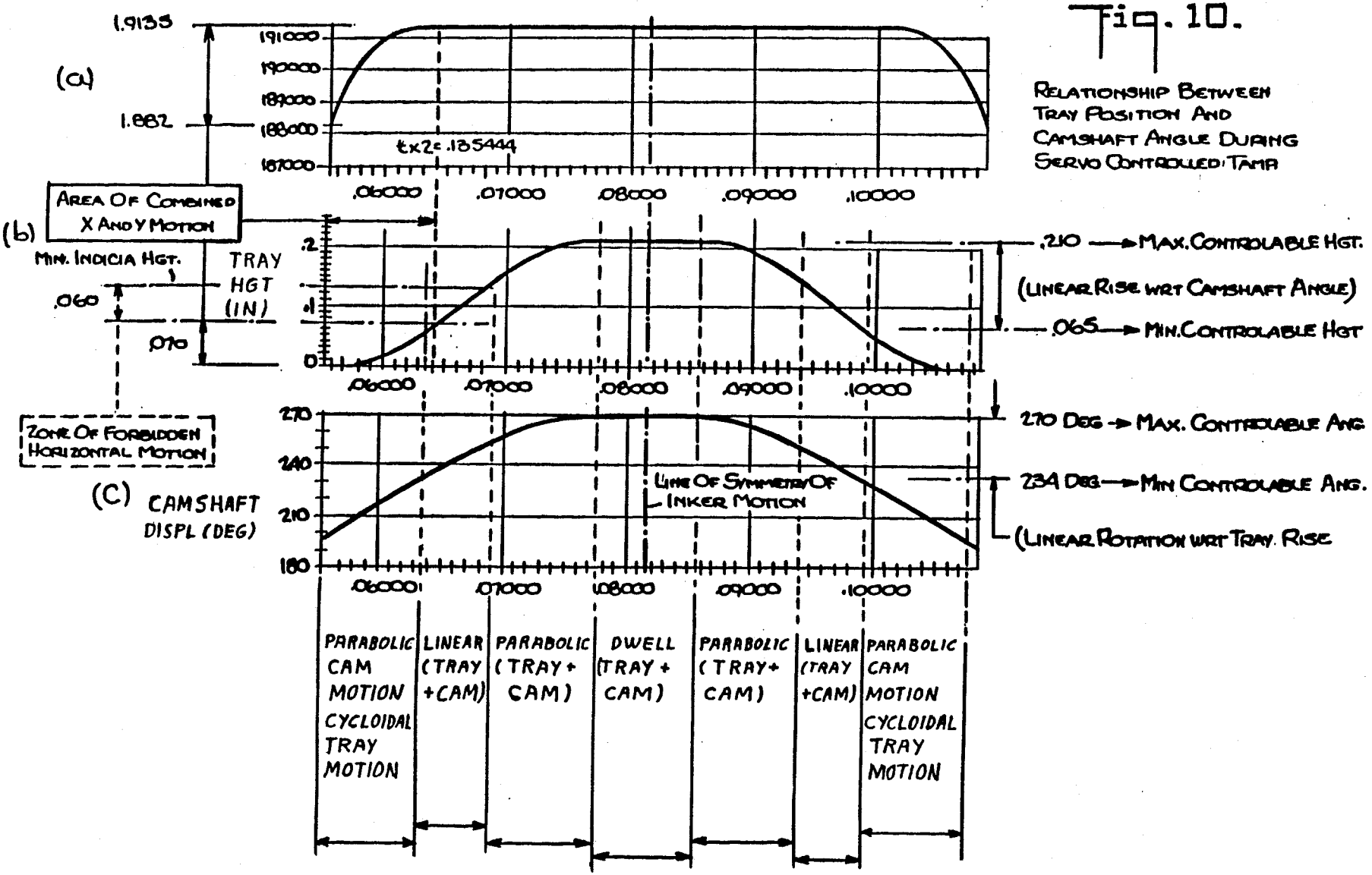
Fig. 10.
Relationship Between Tray Position And Camshaft Angle During Servo Controlled Tamp
.210 → Max. Controllable Hgt.
(Linear Rise wrt Camshaft Angle)
.065 → Min. Controllable Hgt
270 Deg → Max. Controllable Ang
234 Deg → Min Controllable Ang.
(Linear Rotation wrt Tray Rise)
Line Of Symmetry Of Inker Motion
Parabolic Cam Motion Cycloidal Tray Motion
Linear (Tray + Cam)
Parabolic (Tray + Cam)
Dwell (Tray + Cam)
Parabolic (Tray + Cam)
Linear (Tray + Cam)
Parabolic Cam Motion Cycloidal Tray Motion
tx2=.135444
1.9135
1.882
(a)
Area Of Combined X And Y Motion
(b)
Min. Indicia Hgt.
.060
Tray Hgt (In)
.070
Zone Of Forbidden Horizontal Motion
(c)
Camshaft Displ (Deg)

INK TRAY DRIVE

BACKGROUND OF THE INVENTION

The invention disclosed herein relates generally to drive apparatus for moving an object in two transverse directions, and more particularly to inking apparatus especially for a mailing machine for moving an ink pad from a home position to an inking position in which ink is applied to a printing device, and back again to the home position.

In the mail processing field, it is highly desirable to imprint postage and other indicia on envelopes, packages, tapes, etc., at high speed. With such high speed operation, particularly where high volume is involved, it is important to maintain the quality of imprinted postage and the other indicia.

A mailing machine for processing mail, particularly so-called mixed mail, may include a number of modules, for example modules which automatically feed the mail, weigh it and apply postage and indicia either directly to the mail piece or to a tape. Such a mailing machine may include a number of motors, solenoids or other prime movers for driving the various functions performed by the machine, and as the number of functions which the machine must perform increases, so typically does the number of prime movers.

The present invention is an improvement over the ink tray drive disclosed in application Ser. No. 427,946.

SUMMARY OF THE INVENTION

It is an object of the invention disclosed herein to provide an improved apparatus for moving a generally flat object such as an ink pad in two directions in going from a first to a second position.

It is another object of the invention to provide an improved apparatus for moving an ink pad in horizontal and vertical directions from a home position to an inking position in which the ink pad is tamped against a printing device, and back to the home position.

It is another object of the invention to provide apparatus for moving an ink pad from a home position to an inking position and for pumping ink from a reservoir to the ink pad.

It is another object of the invention to provide such apparatus which utilize a single prime mover such as a motor.

It is another object of the invention to provide such apparatus capable of high speed operation.

It is another object of the invention to reduce the number of prime movers required in a mailing machine to perform a given number of functions.

The above and other objects are achieved by the invention disclosed herein which provides apparatus for moving a generally flat object such as an ink pad in two directions, for example, horizontally and vertically, utilizing camming means, links and a single prime mover. In the case of an ink pad, the apparatus may move the ink pad from a home position to an inking position in which the ink pad is tamped against a printing device, and may also operate a pump for pumping ink to the ink pad, preferably by means of the single prime mover, the camming means and links. The apparatus is preferably capable of high speed operation, for example, up to four or more ink pad tamping cycles per second.

In accordance with one embodiment of the invention, such apparatus comprises a first link coupled at a first end thereof to the object and a second link coupled at a first end thereof to the object. The apparatus further includes camming means having first and second camming surfaces, with the first link having at a second end thereof a cam follower surface and the second link having at a second end thereof a cam follower surface. The first link is supported such that its cam follower surface engages the first camming surface and is cammed thereby to move the first link upon movement of the camming means, and the second link is supported such that its cam follower surface engages the second camming surface and is cammed thereby to move the second link upon movement of the camming means. The first link is configured and coupled to the object, the second link is configured and coupled to the object, and the camming surfaces are configured such that a given movement of the camming means, e.g., a given angle of rotation, causes the first link to move the object a given distance in the first direction, and a given movement of the camming means moves the object a given distance in the second direction.

In a specific embodiment, the camming means comprises a cam wheel having the first and the second camming surfaces and means for rotating the cam wheel over the given angle to cause the first link to move the object the given distance in the first direction and over a given angle to cause the second link to move the object the given distance in the second direction.

The camming means may comprise a plurality of first camming surfaces and a plurality of second camming surfaces, and the apparatus may comprise: a plurality of first links extending spaced from each other and parallel to each other coupled at respective first ends thereof to the object at spaced locations thereof and engaging respective first camming surfaces at respective second ends thereof, a plurality of second links extending spaced from each other and parallel to each other coupled to the object at spaced locations thereof and engaging respective second camming surfaces at respective second ends thereof, with the first and second links and the camming means moving the object in the given directions. The camming means may comprise a plurality of cam wheels each having a first and a second camming surface and means for rotating the cam wheels over the given angles The apparatus in a specific embodiment includes the plurality of first and second links and a support, e.g., a platform-like support The second links are pivotally coupled to the support between the first and second ends of the second links. The second links movably support the object above the support, and the first and second links move the object horizontally relative to the support and vertically relative to the support in moving the object from the first position to the second position.

The invention also provides an ink pump for pumping ink from a reservoir to an ink pad, preferably at least once for each tamping of the ink pad against the printing device.

In accordance with the invention, apparatus is provided for sequentially moving the ink pad from the home position to the inking position, with the ink pump pumping ink to the ink pad each time it is moved from the home to the inking positions. Such apparatus comprises means for moving the ink pad from the home to the inking positions and back again; the ink pump for pumping ink from a reservoir to the ink pad; and means coupled to the means for moving for actuating the ink pump once for each time that the ink pad is moved from its home position to its inking position and back again.

The pump may be any type of pump. In a specific embodiment, which is presently preferred, the pump comprises a deformable chamber and valving such that upon compression of the chamber, ink therein is expelled for delivery to the ink pad and upon release of the compression ink is drawn therein from the reservoir.

In a specific embodiment, such apparatus includes the ink pump described above, the first and second links and the camming means described above, and a third link having structure at a first end thereof configured to compress the ink pump chamber. The third link has at a second end thereof a cam follower surface, and the camming means has a third camming surface. The third link is supported such that its cam follower surface engages the third camming surface and is cammed thereby to move the third link and compress the chamber upon a given movement of the camming means. The third link may be configured and supported and the third camming surface may be configured such that the structure at the first end of the third link compresses the chamber and releases compression thereof once each time that the ink pad is moved from the home position to the inking position and back again.

The camming means may comprise the cam wheel described above having the first and second camming surfaces and may also have a third camming surface which the follower of the third link engages to cause the third link to compresses the pump chamber for a given rotation of the cam wheel.

BRIEF DESCRIPTION OF THE DRAWINGS

The invention is illustrated by way of example and not limitation in the figures of the accompanying drawings in which like references denote the same elements, and in which:

FIG. 10 consisting of FIGS. 10*a*, 10*b*, and 10*c* is a series of plots showing the relationship between the horizontal and vertical positions of the ink pad tray and the angle of the ink pad drive camshaft with respect to movement of the ink pad tray shortly before, during and shortly after tamping thereof against the printing device;

DESCRIPTION OF THE PREFERRED EMBODIMENTS

Figure 1:
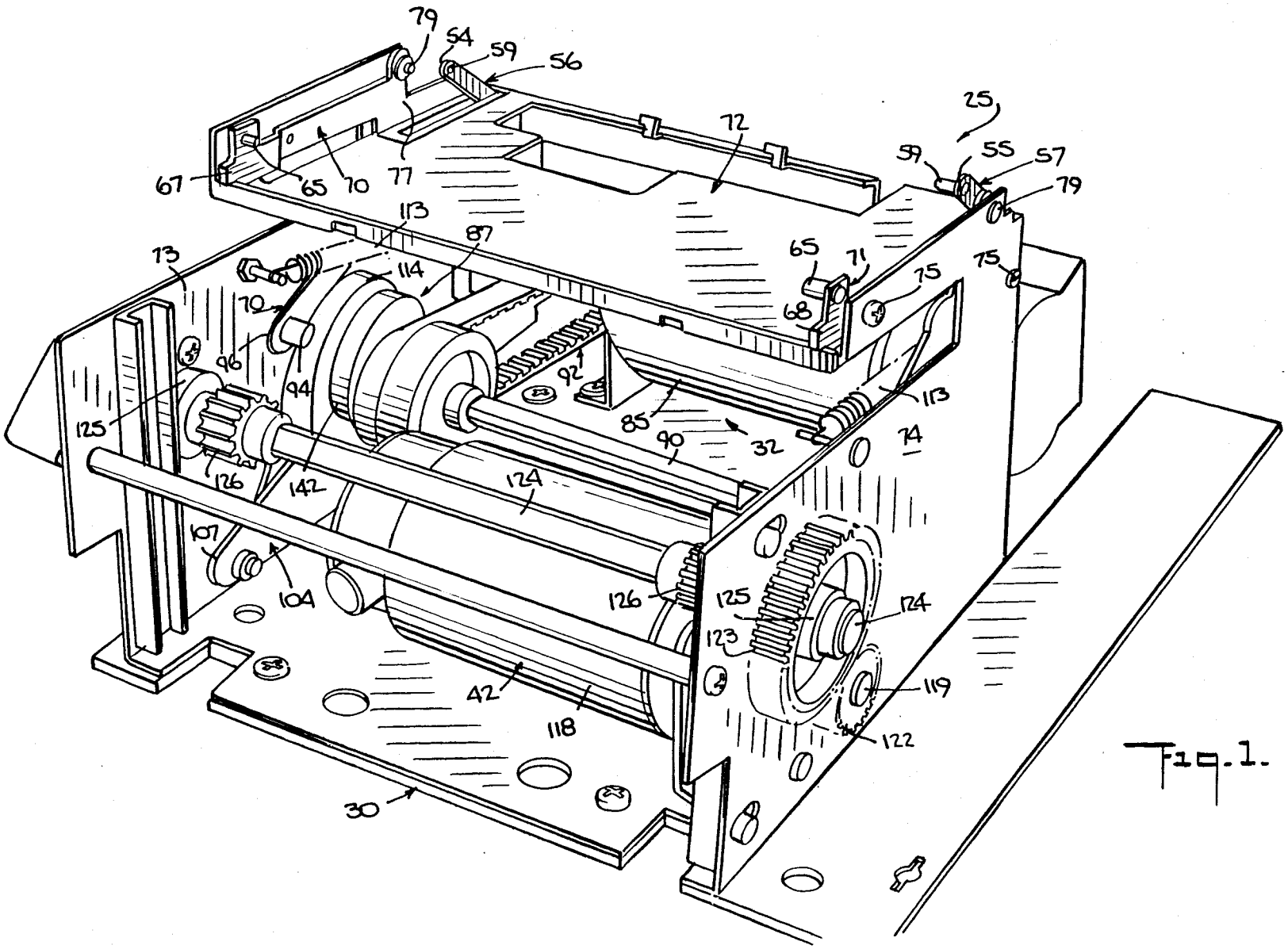
FIG. 1 is a front perspective view of a drive according to the invention for moving an ink pad tray from a home position to an inking position in a mailing machine.
Figure 2:
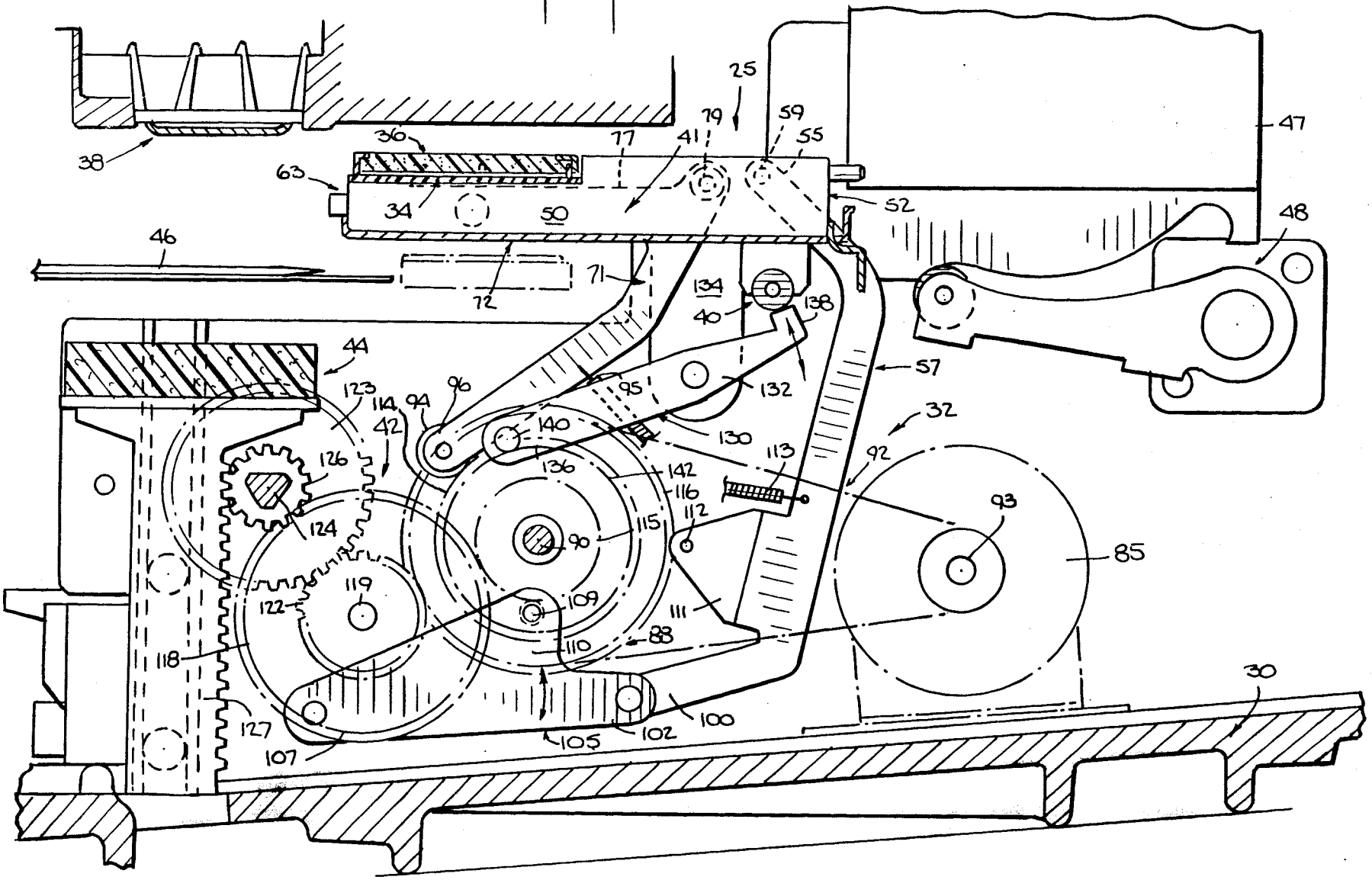
FIG. 2 is a sectional view of the drive of FIG. 1, also showing the ink pad tray in its home position, and a pump for the ink pad, a printing device and a platen device in its home position.
Figure 7:
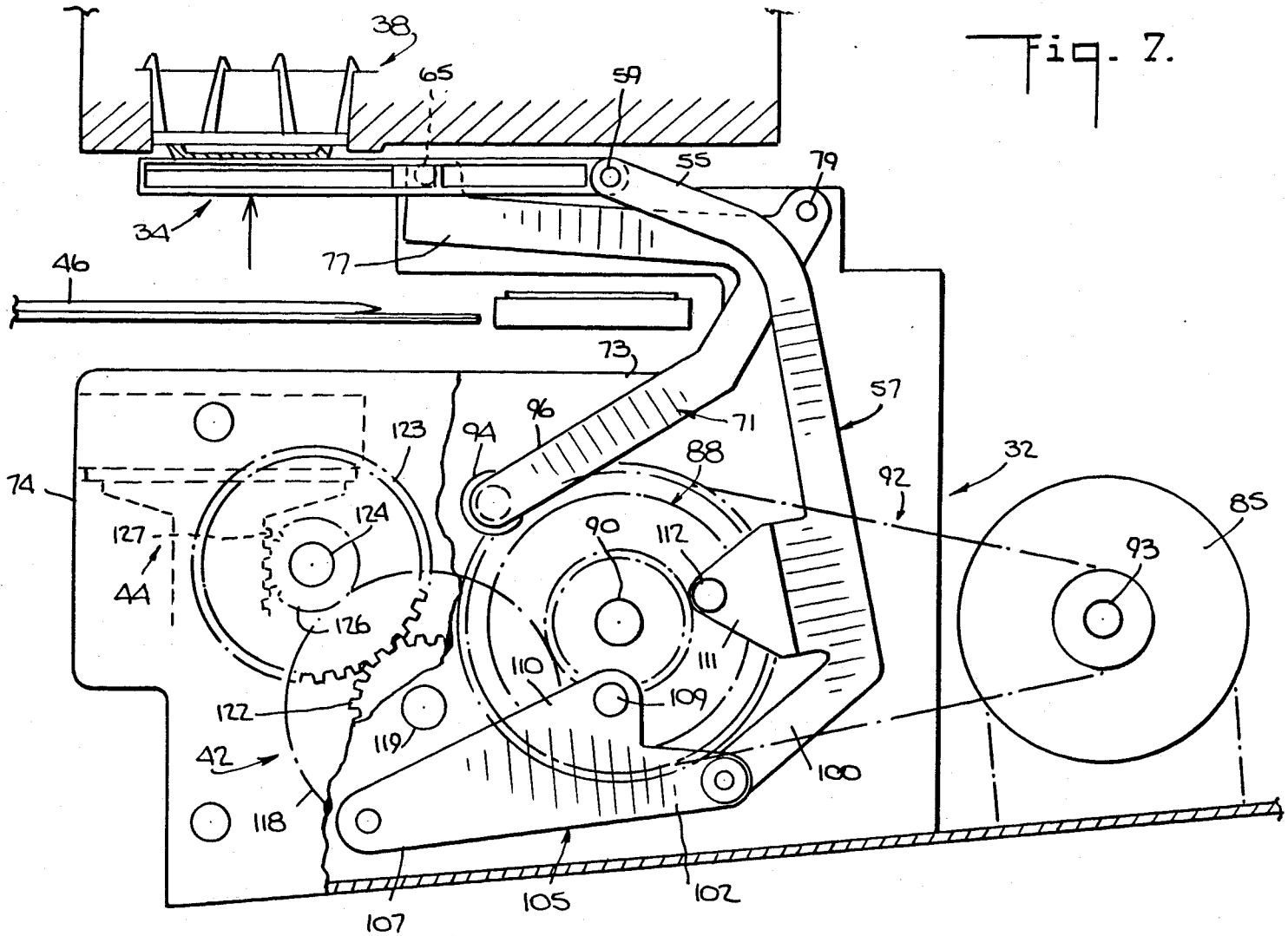
Figure 8:
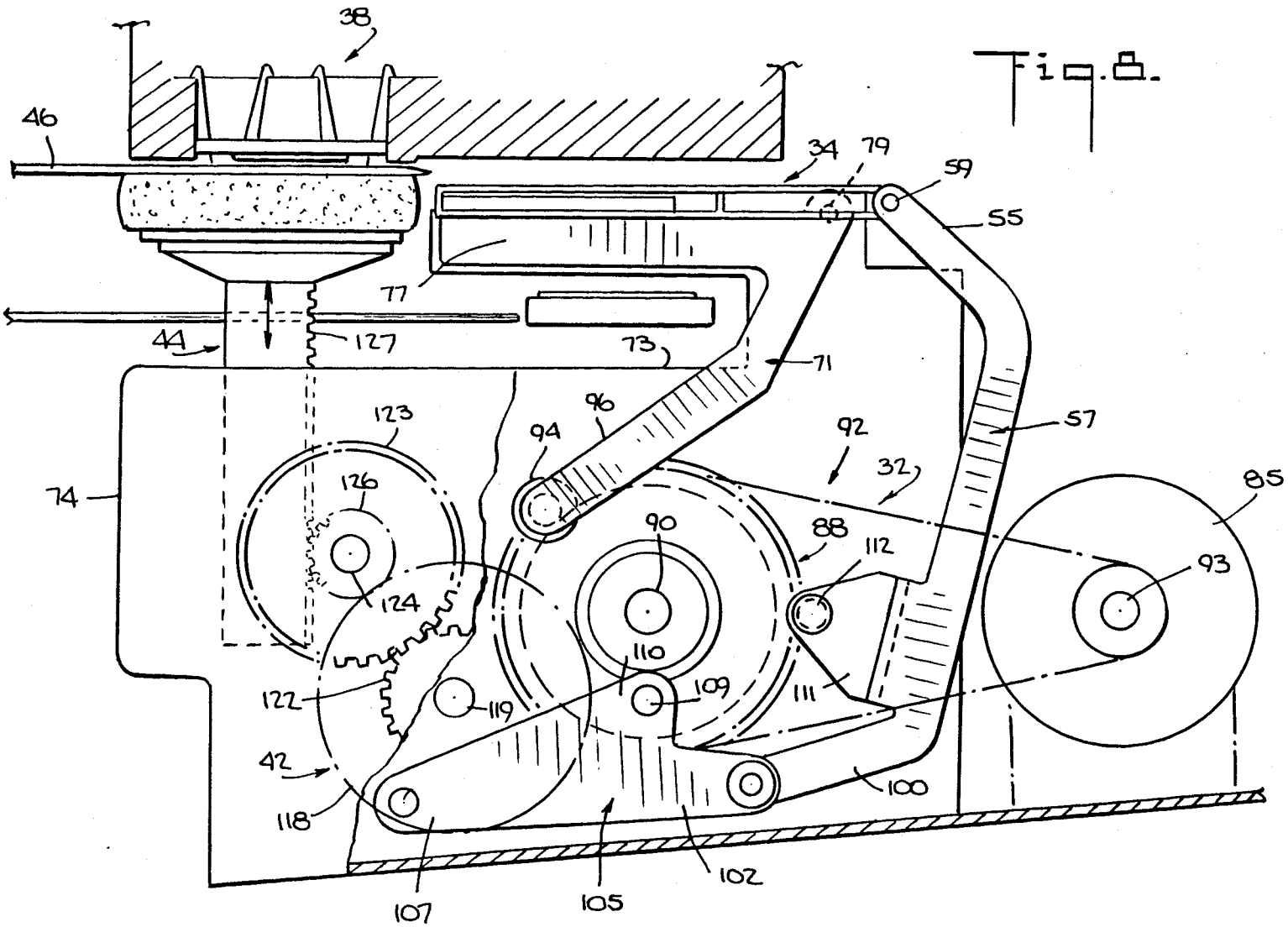
FIG. 8 is a view similar to that of FIG. 4 showing the ink pad tray back in its home position and the platen device in its printing position tamping an envelope or tape against the printing device for imprinting the envelope.

Referring to FIGS. 1 and 2, inker module 25 includes a chassis 30 which houses drive 32 that (a) moves an ink pad tray 34 (FIG. 2) from a home position (FIG. 2) to an inking position (FIG. 7) in which an ink pad 36 (FIG. 2) is tamped against a printing device 38 (FIG. 2) to ink the printing device; and (b) actuates a pump 40 (FIG. 2) to pump ink from a reservoir 41 in ink pad tray 34 to ink pad 36. Chassis 30 also houses drive 42 which moves platen device 44 (FIG. 2) upwardly from a home position (FIG. 2) to a printing position (FIG. 8) in which an envelope or strip of tape 46 is pressed against printing device 38 to imprint postage indicia thereon. Printing device 38 is part of a flat-bed postage meter referenced generally by 47 (FIG. 2) which is pivotally mounted by a counterbalance mechanism 48 in a system including inker module 25.

Ink tray 34 at opposed sides 50 (FIG. 2) adjacent its rear 52 is pivotally connected to ends 54, 55 (FIG. 1) of links 56, 57, respectively, by inwardly projecting pins 59 from links 56, 57 snap fitted in receptacles 61 (FIG. 18) of ink tray 34. The forward part 63 of ink tray 34 is supported by pins 65, (FIG. 1) inwardly projecting from ends 67, 68 of links 70, 71, respectively. That snap-fit arrangement facilitates replacement of ink tray 34 as described in more detail below. Platform 72 is fixed to chassis 30 so that links 56 and 57 move relative to platform 72. Pins 65 extend into slots or cut-outs 73 in sides 50 of ink tray 34 (FIG. 18) so that ink tray 34 may be moved by links 56 and 57 relative to platform 72 riding on pins 65. Platform 72 is attached to opposed sides 73, 74 (FIG. 1) of chassis 30 by screws 75 so that it may be removed for ease of assembling, disassembling and servicing of drives 32 and 42. Links 70 and 71 are pivotally attached in a central region 77 thereof to platform 72 by pins 79 so that ends 67 and 68 of links 70 and 71 pivot upwardly (clockwise) relative to platform 72. Movement of links 56 and 57 to the left in FIG. 1 move ink tray 34 horizontally to the left relative to platform 72, and clockwise pivoting of links 70 and 71 moves ink tray 34 vertically upwardly.

Figure 4:
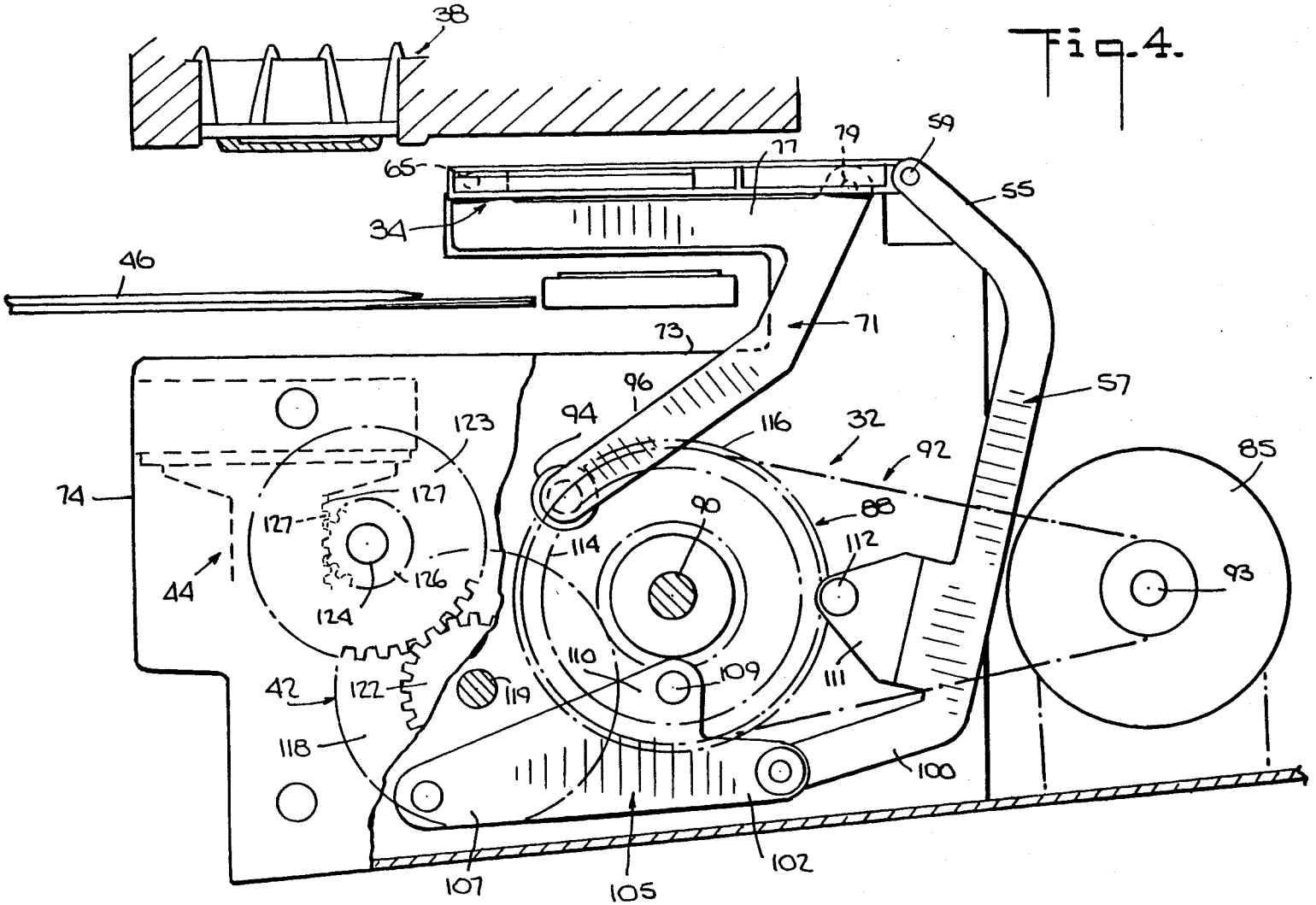
FIG. 4 is a simplified side view partially broken away of the drive, ink pad, ink pad tray, platen device and printer device depicted in FIG. 3 with the ink pad tray and the platen device in their home positions.
Figure 5:
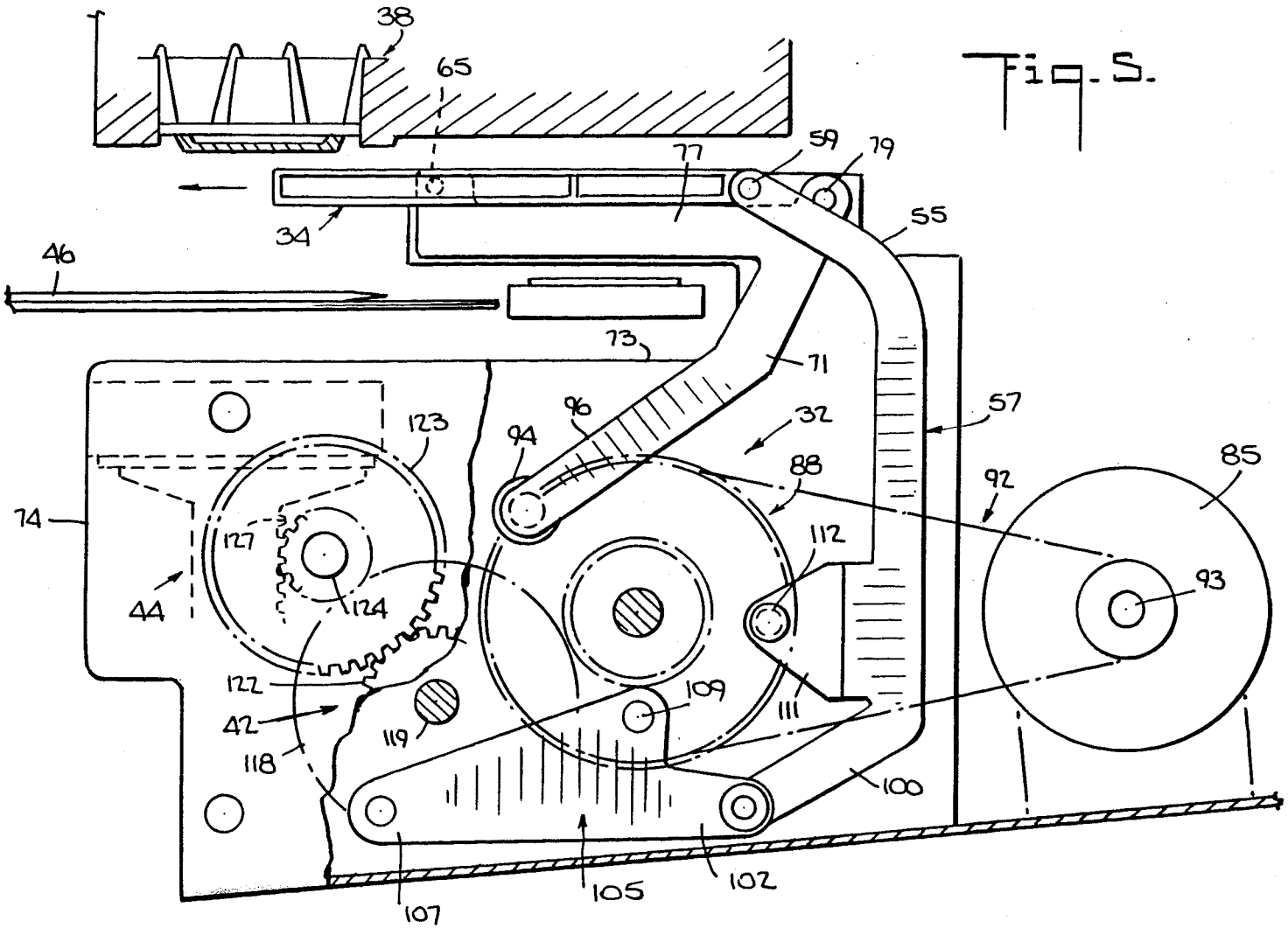
FIGS. 5–7 are views similar to that of FIG. 4 showing the motion of the ink pad tray in stages from its rest position depicted in FIG. 4 to its inking position depicted in FIG. 7 with the ink pad tamped against the printing device, the platen device being shown in its home position.
Figure 6:
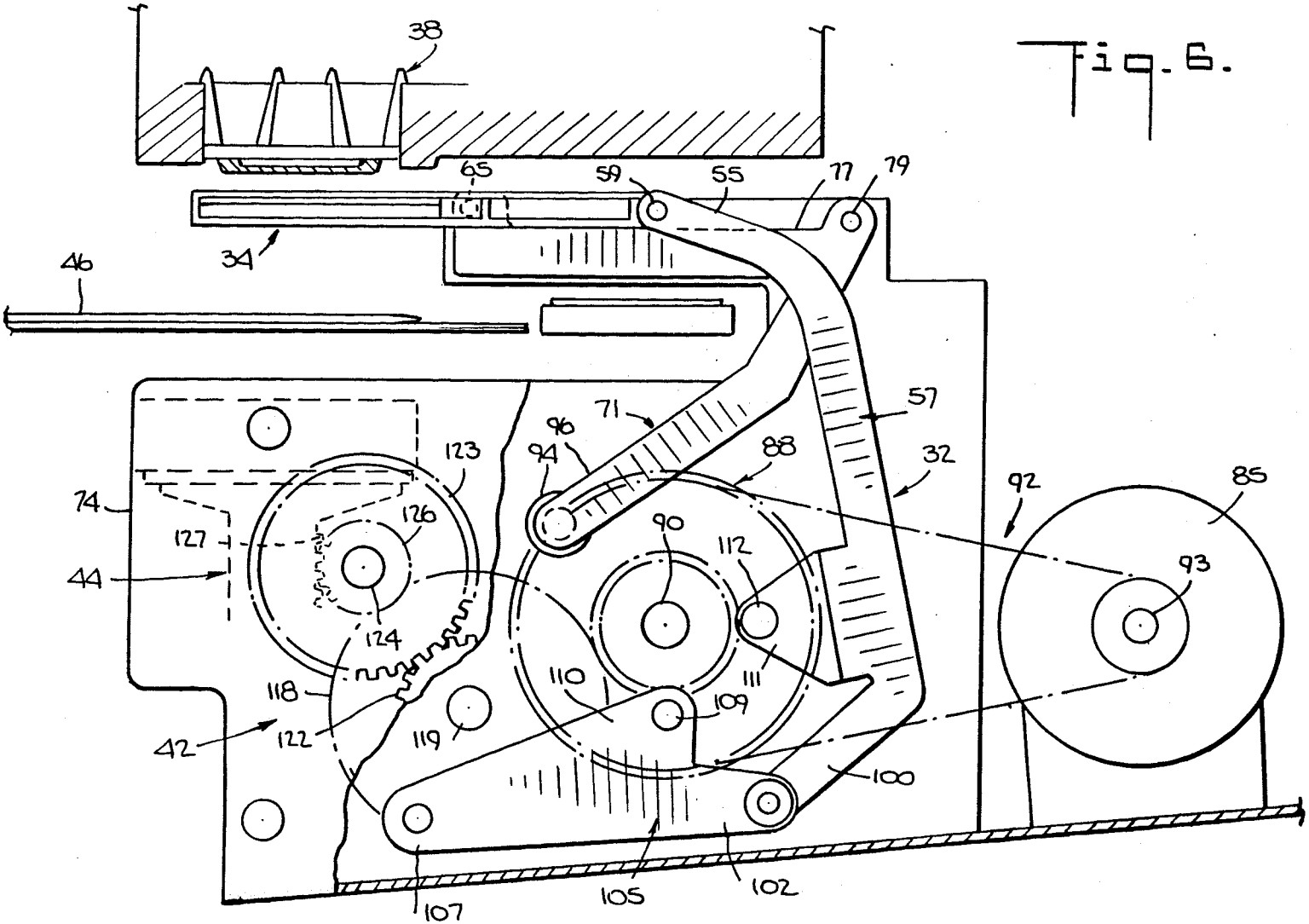

Drive 32 first moves links 56 and 57 to the left, as illustrated by the sequence of FIGS. 4–6, to move ink tray 34 horizontally to the left from its rest position (FIG. 4) to a position registered with printing device 38 (FIG. 6). Drive 32 then pivots links 70 and 71 (FIG. 7) to move ink tray 34 vertically and tamp it against printing device 38 to ink it. After drive 42 raises platen device 44 to press an envelope or tape strip 46 against printing device 38, drive 32 moves links 70 and 71, and links 56 and 57 move in reverse to the movements that brought ink tray 34 into its inking position, and return ink tray 34 to its home position.

Drive 32 (FIG. 3) includes drive motor 85, cam wheels 87, 88 fixed to camshaft 90 journaled to sides 72 and 73 of chassis 30, and pulley system 92 coupling motor shaft 93 and camshaft 90. Links 70 and 71 have respective rollers 94 rotatably connected to respective ends 96 thereof and are supported from chassis sides 72 and 73 such that respective rollers 94 ride on cam wheels 87 and 88, respectively. Springs 95 urge links 72 and 73 towards cam wheels 87, 88, and urge rollers 94 thereof into engagement with cam wheels 87, 88. Links 56 and 57 are pivotally connected at respective ends 100 thereof to respective ends 102 of links 104 and 105, respectively. Links 104 and 105 are pivotally connected at respective ends 107 to chassis sides 73 and 74, respectively, and have respective rollers 109 rotatably connected to a respective central part 110 thereof. Links 56 and 57 have rotatably connected to a respective central part 111 (FIG. 2) thereof respective rollers 112. Springs 113 urge links 56 and 57 towards cam wheels 87, 88, and urge rollers 112 thereof into engagement with cam wheels 87, 88. Cam wheels 87 and 88 each include a cam surface 114 on which a respective roller 94 rides, a cam surface 115 on which a respective roller 109 rides, and a cam surface 116 on which a respective roller 112 rides. Links 56 and 104, and links 57 and 105 are interconnected and supported such that respective rollers ride on respective cam surfaces of cam wheels 87 and 88, respectively, as respective cam followers. The cam surfaces are contoured to move the various links upon a given rotation of camshaft 90 to provide the motion of ink tray 34 described above and defined by FIG. 9, and the cam surfaces are aligned axially offset, as shown, or may be circumferentially aligned along the respective outer peripheries of cam wheels 87, 88. Cam wheels 87, 88 may be rotated through a cycle, with constant velocity or continuously with variable velocity, or cam wheels 87, 88 may be oscillated through a cycle.

Figure 3:
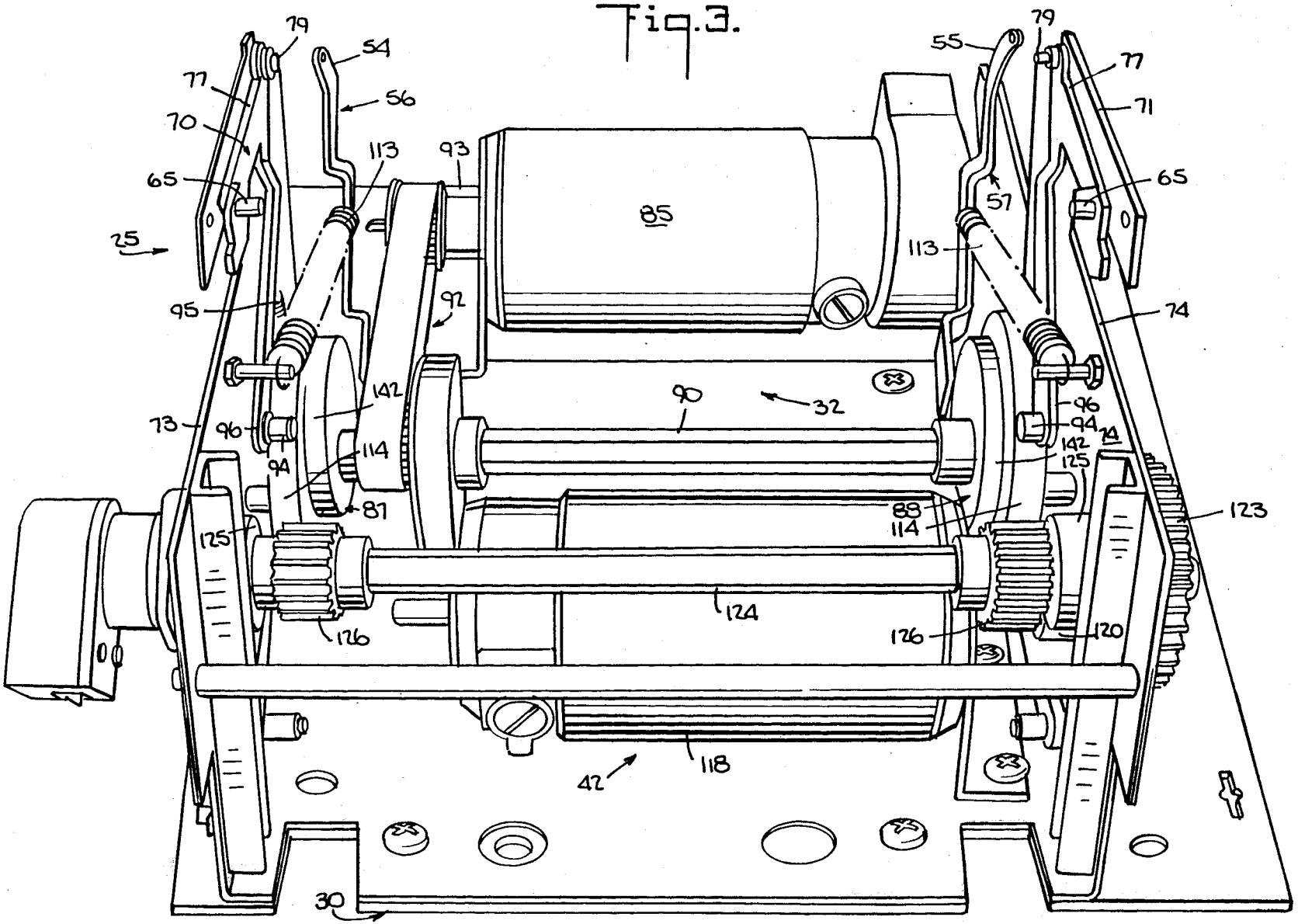
FIG. 3 is a front prospective view of the drive depicted in FIG. 1.

Referring to FIGS. 1–3, drive 42 includes motor 118 having motor shaft 119, supported from sides 73, 74 of chassis 30 by bearing 120 (FIG. 3), gear 122 fixed to shaft 119, gear 123 meshing with and driven by gear 119, shaft 124 fixed to gear 123 and supported from chassis 30 by bearings 125, pinion gears 126 fixed to shaft 124, and racks 127 (FIG. 2) fixed to opposed sides of platten device 44 meshed with respective pinion gears 126. Actuation of motor 118 causes pinion gears 126 to rotate, engaging and elevating respective racks 127 and with them platten device 44. FIGS. 4–8 show elevation of platten device 44 with respect to movement of ink pad tray 34.

In order to produce straight line (e.g. generally horizontal) and parallel motion (e.g., parallel to the indicia surface of printing device 38), links 57 must experience some orthogonal motion (e.g., generally vertical). Links 105 and the corresponding cam surfaces cooperate with links 57 to provide that motion. Additionally, links 105 and the corresponding cam surfaces provide the orthogonal (vertical) motion during tamping.

Figure 9:
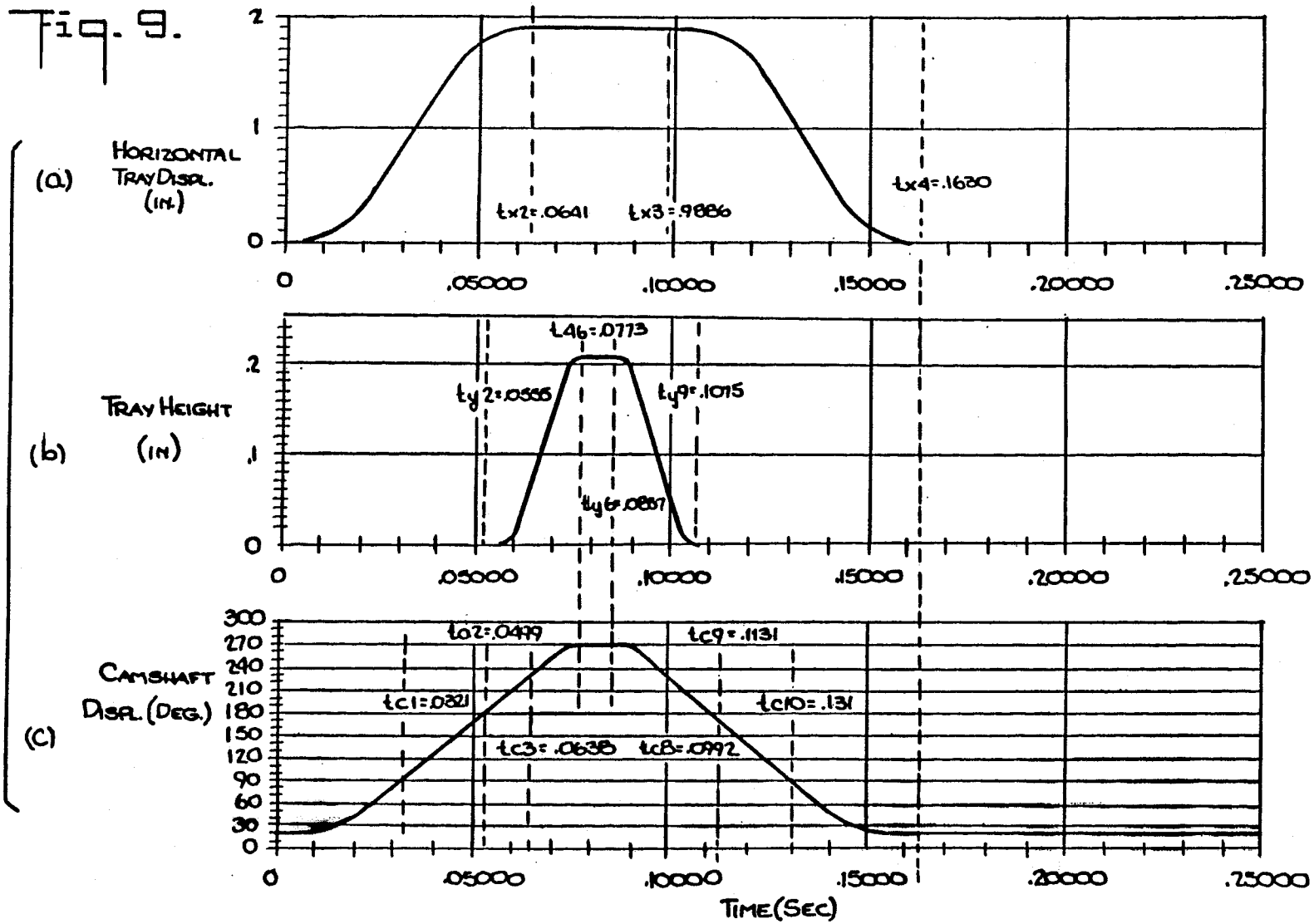
FIG. 9 consisting of FIGS. 9*a*, 9*b* and 9*c* is a series of plots showing the relationship between the horizontal and vertical positions of the ink pad tray and the angle of the ink pad drive camshaft with respect to movement of the ink pad tray from its home to its inking position.

The relationship between ink tray movement and camshaft 90 rotation is given in FIG. 9. FIG. 9(*a*) shows horizontal ink tray movement versus time; FIG. 9(*b*) shows vertical ink tray movement versus time; and FIG. 9(*c*) shows camshaft angle rotation versus time. The ordinate axes time scales in FIGS. 9 (*a*), (*b*) and (*c*) are identical, so that viewing FIG. 9(*a*) and/or FIG. 9(*b*) with FIG. 9(*c*) gives horizontal and/or vertical displacement versus camshaft angle.

The plots in FIGS. 10(*a*), (*b*), and (*c*) are similar to the corresponding plots in FIG. 9 and give the relationship between ink pad tray movement and camshaft angle on an expanded side shortly before, during and shortly after the ink tray is tamped against the printing device, and include additional information. The cam profiles are configured to ensure that there is a bounceless strike of ink pad 36 against printing device 38, i.e., once ink pad 36 has been tamped against printing device 38 and it starts its downward movement, it is prevented from restriking printing device 38. FIG. 10 also gives ranges for acceptable ink tray vertical heights and indicia heights. The cam profiles are further configured to provide smooth acceleration and deceleration.

As mentioned above, drive 32 also actuates a pump 40 which pumps ink from reservoir 41 to ink pad 36. Referring to FIG. 2, link 130 is pivotally supported in its central part 132 from bracket 134 of chassis 30 with link end 136 adjacent cam wheel 88 and link end 138 adjacent pump 40. Roller 140 is rotatably connected to end 136 of link 130, and link 130 is configured and supported so that roller 140 rides on cam surface 142 as a cam follower. Rotation of cam wheel 88 pivots link 130 so that end 138 compresses pump 40 to create a pumping action therein as described below. Pump 40 is compressed once for each tamping of ink pad 36 against printing device 38, or less than once or more than once depending upon the amount of ink required. In the disclosed embodiment, pump 40 is compressed once for each ink pad tamping. It is preferred that pump 40 be compressed starting shortly before and during a substantial portion of the time that ink pad 36 is tamped against printing device 38. At high speed operation, it is preferred to pump only once per inking cycle to allow enough time for the pump material to relax to its original shape before compressing it again.

Figure 11:
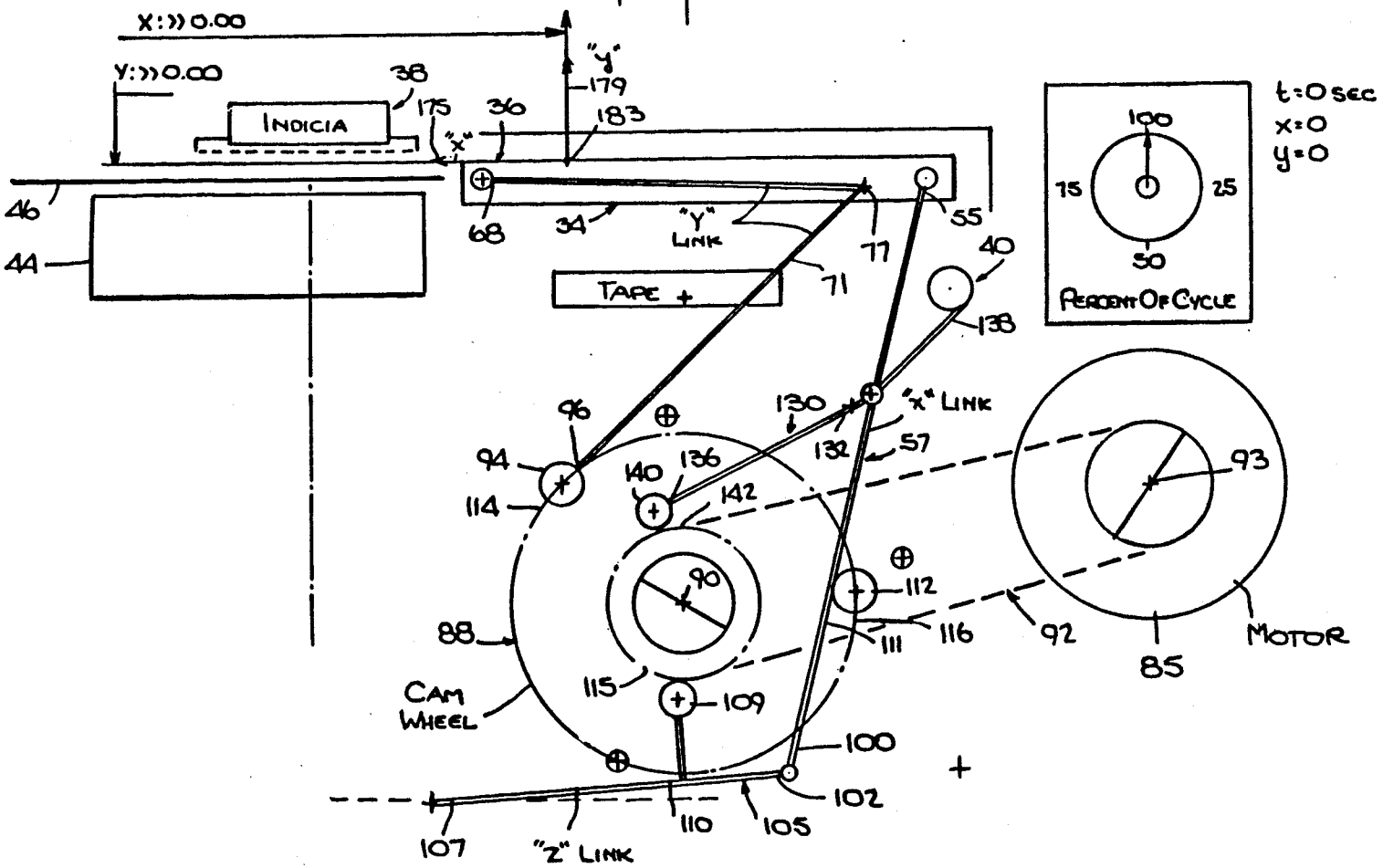
FIGS. 11–17 are stick diagrams illustrating the relative positions of drive linkages, the ink pump linkages and the drive camshaft and showing the percentage completed of the inking cycle in moving the ink tray from its home position to its inking position.
Figure 12:
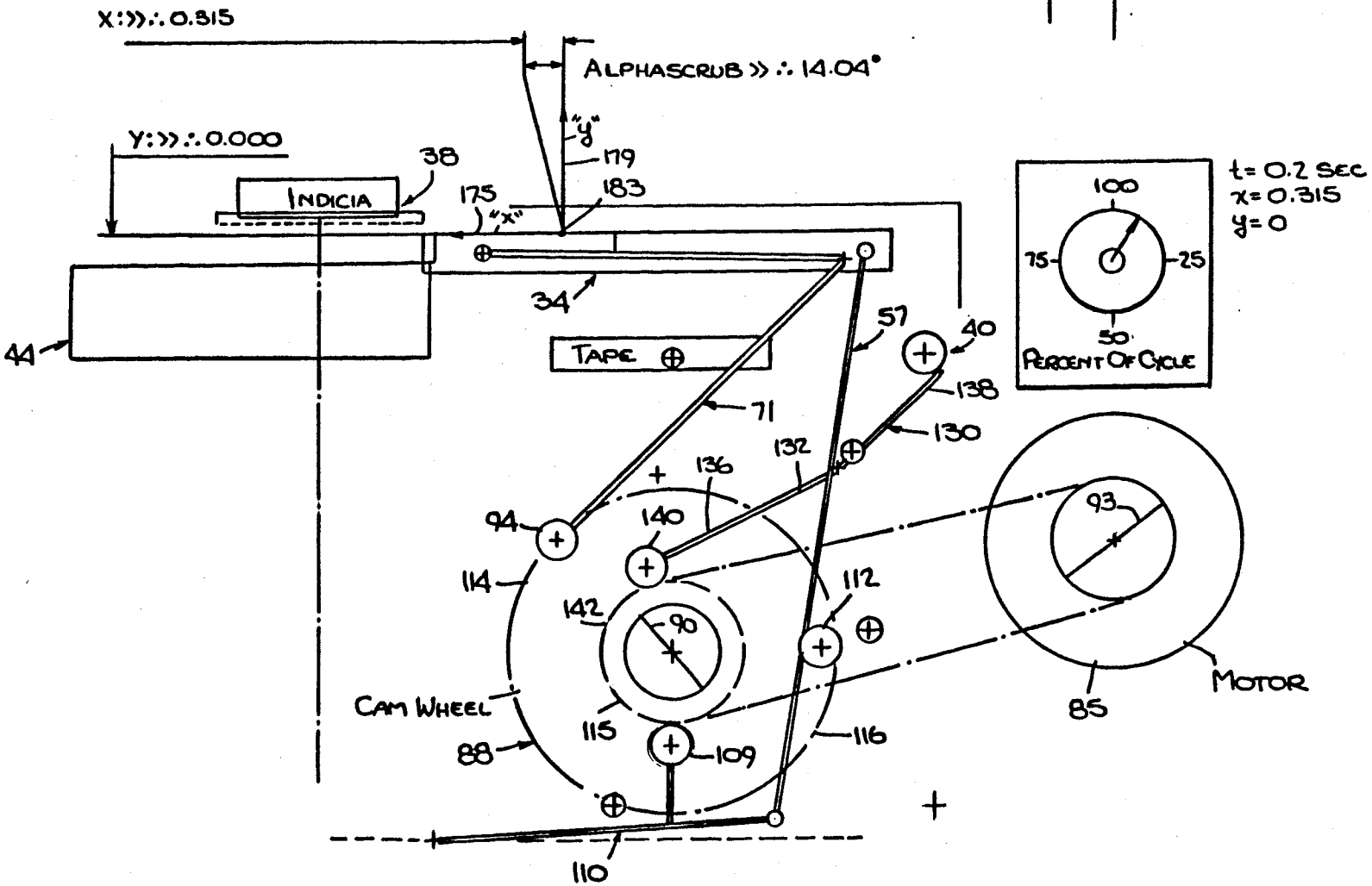
Figure 13:
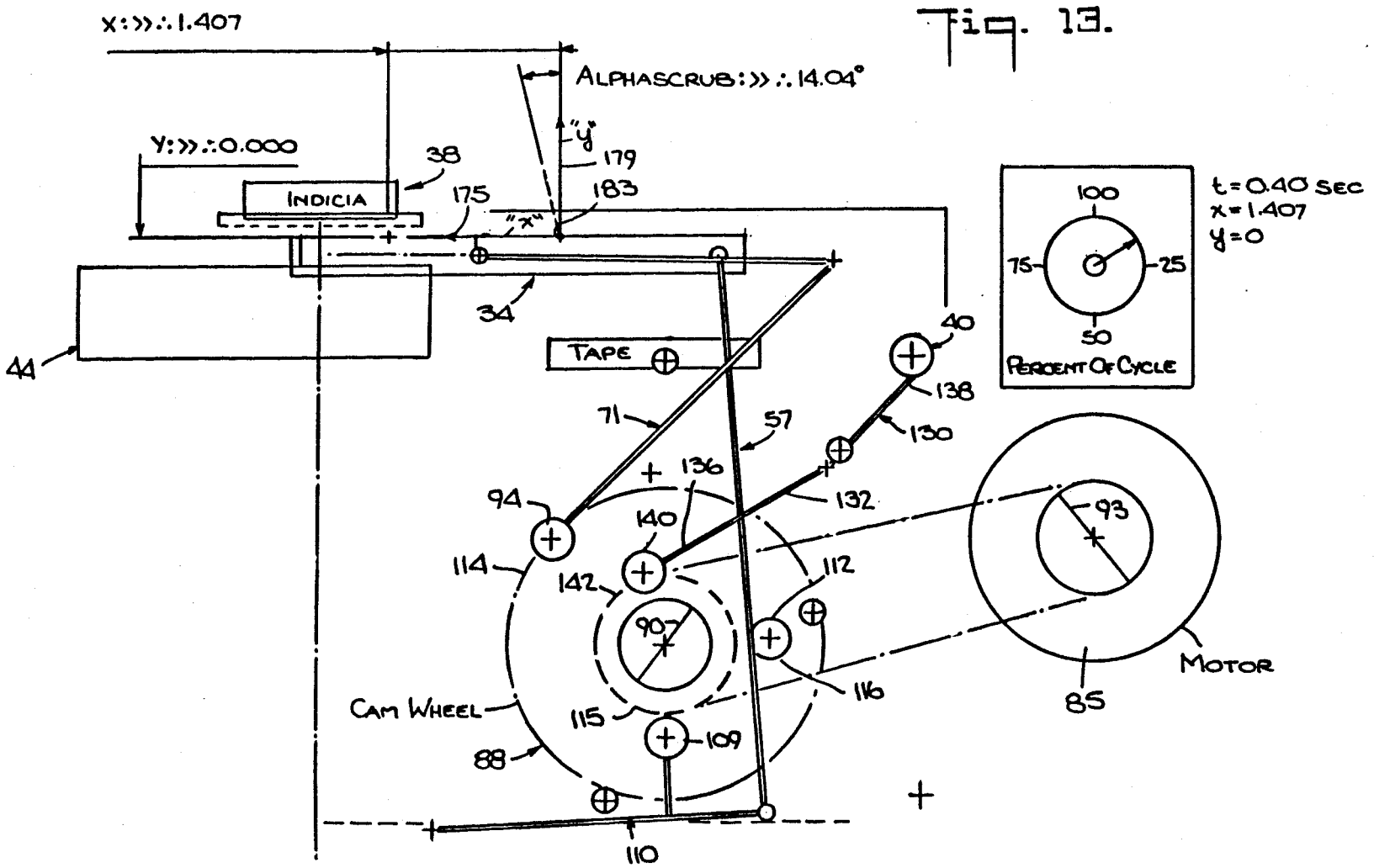
Figure 14:
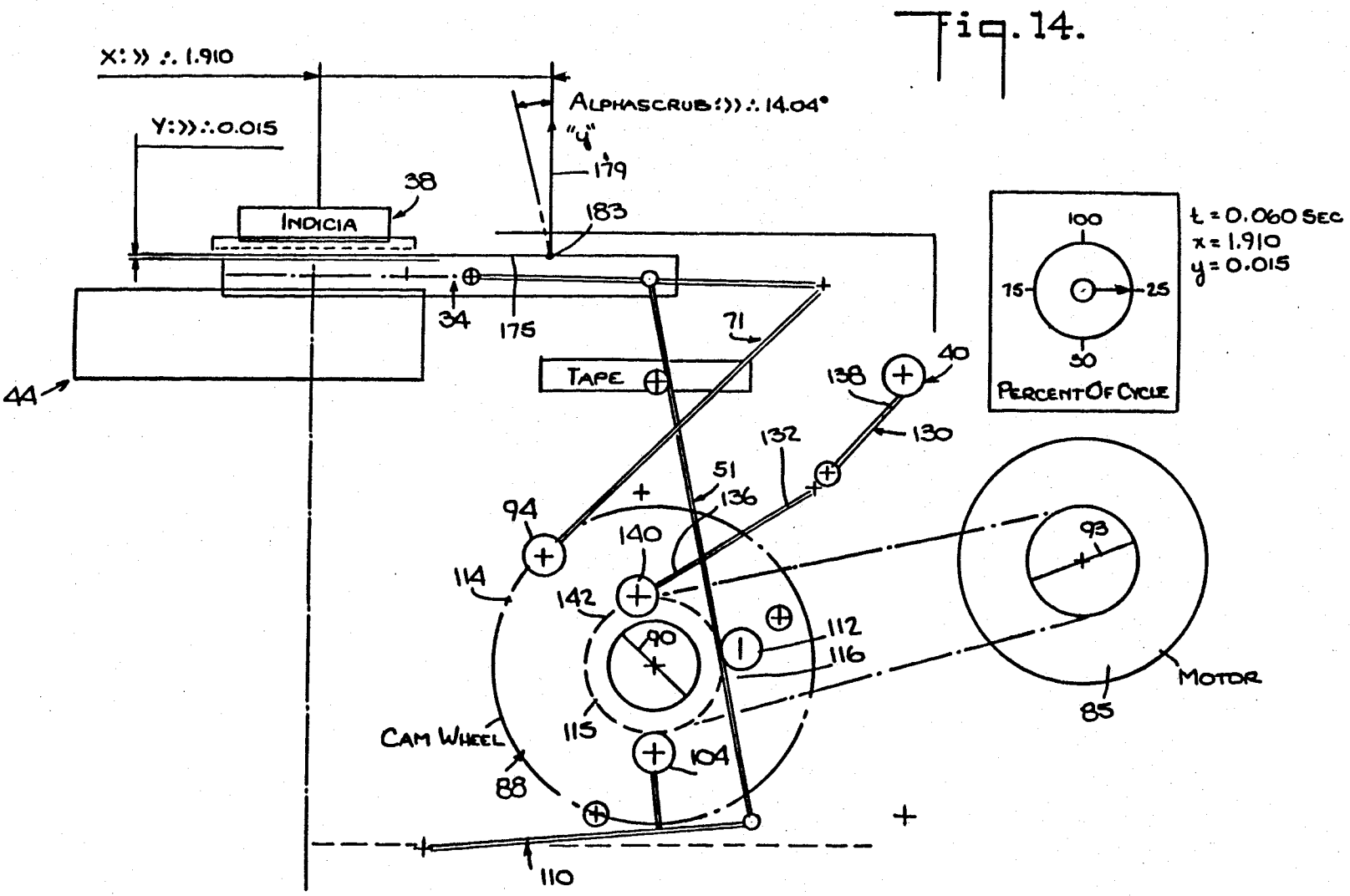
Figure 15:
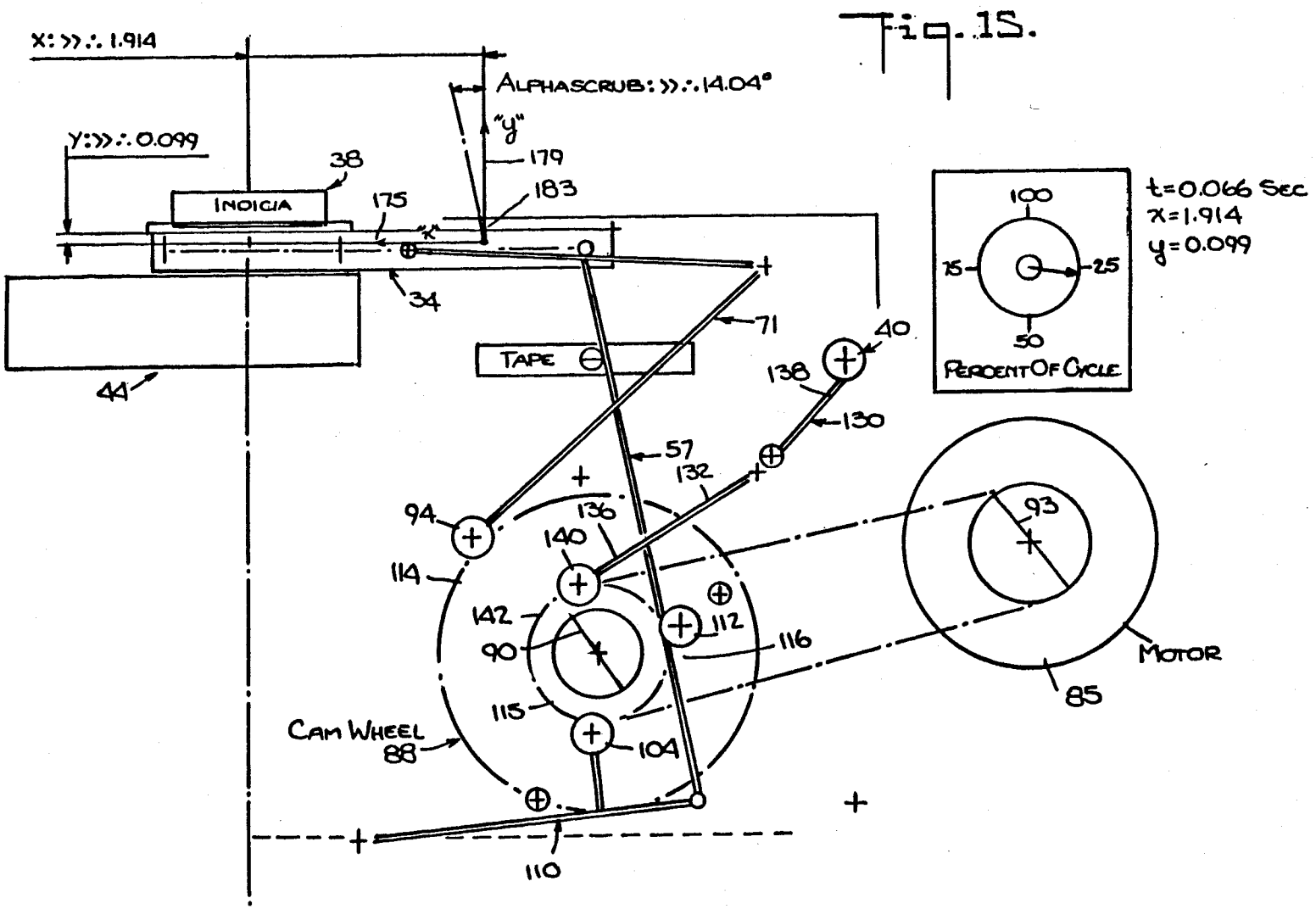
Figure 16:
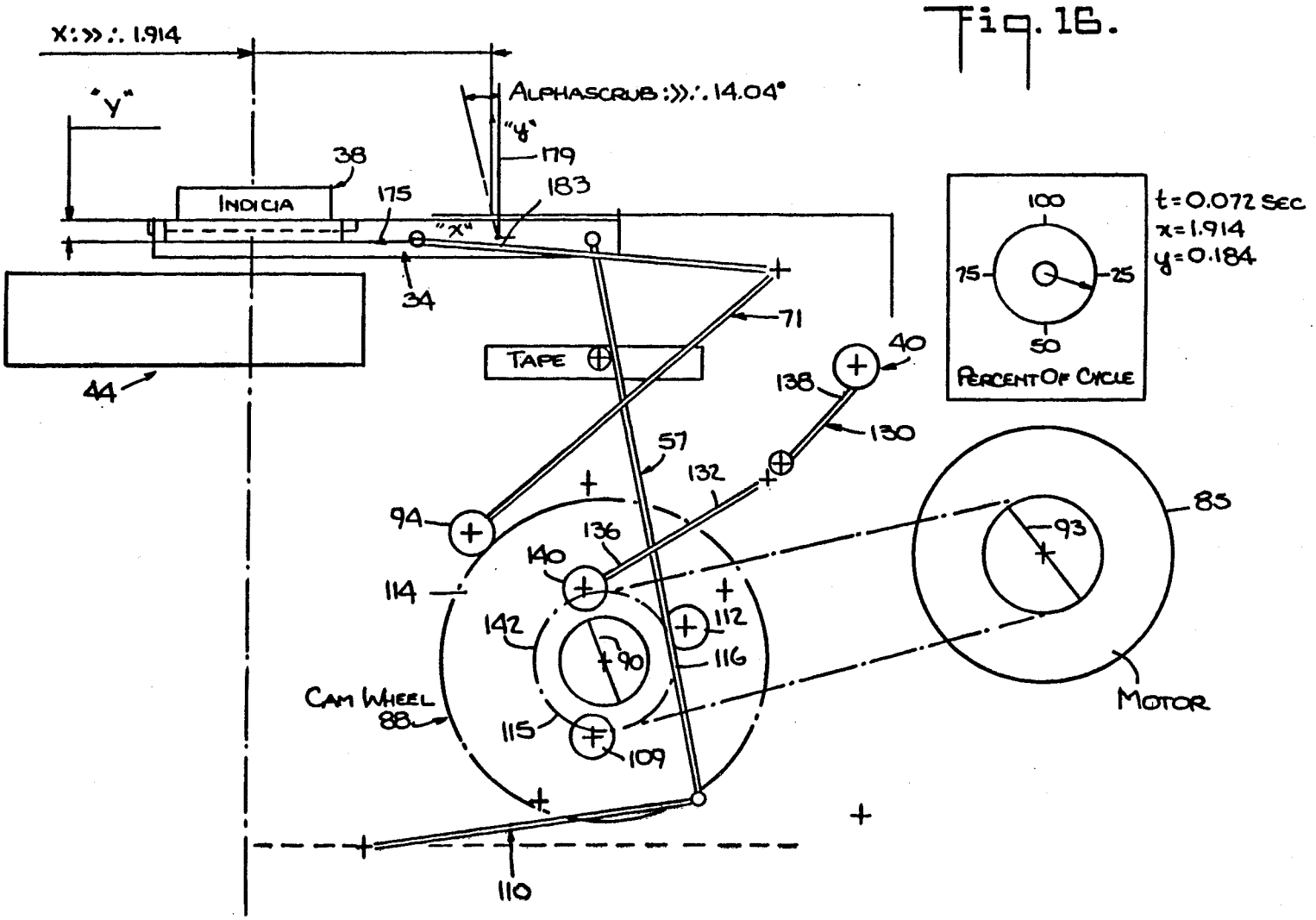
Figure 17:
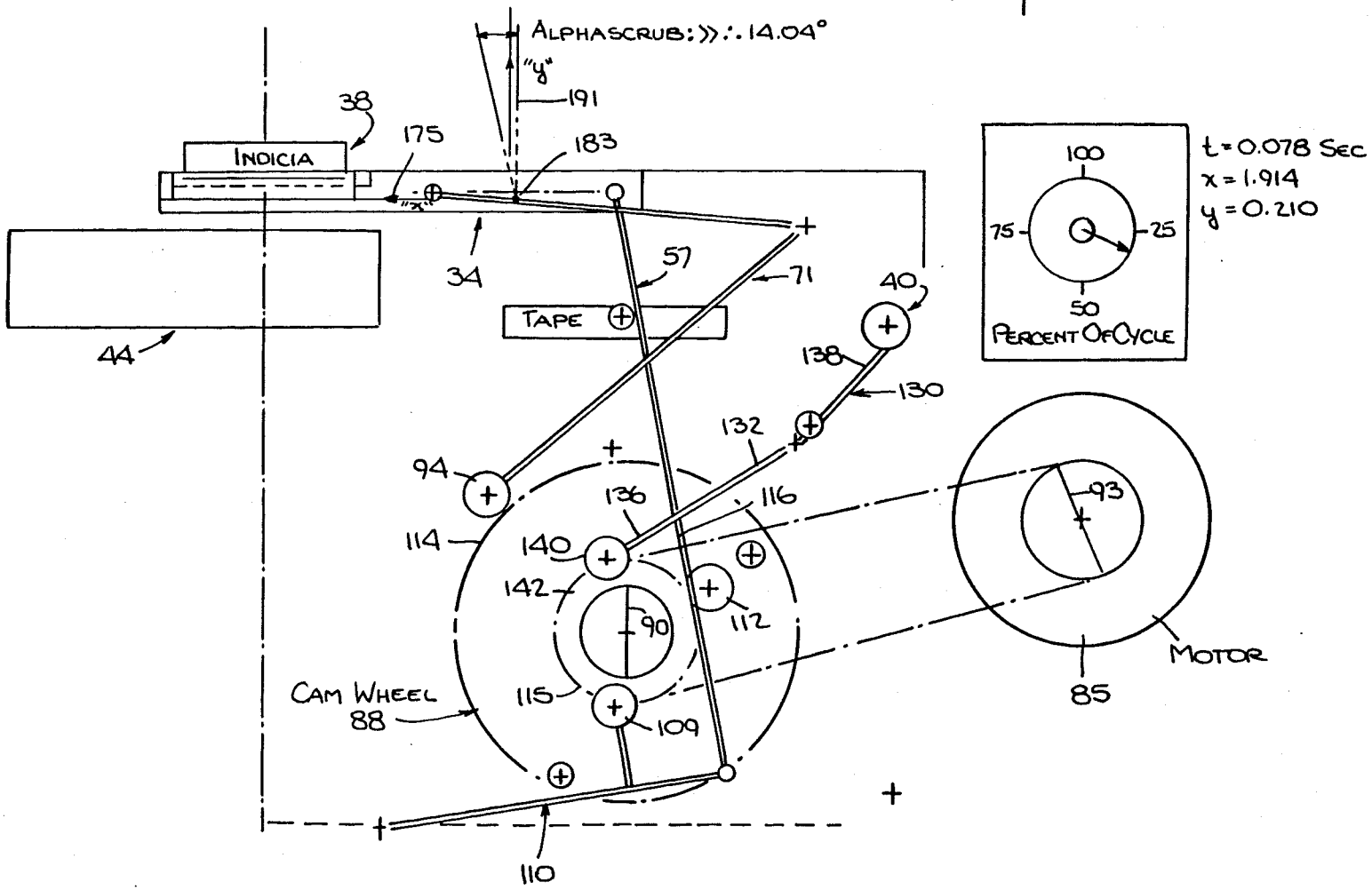

FIGS. 11–17 show the relative positions of links 57, 71, 105 and 130, rollers 96, 109, 112 and 140, cam Wheel 88, ink tray 34, printing device 38, platen device 44 and pump 40 for different times of the inking cycle indicated in each figure as a percentage of the inking cycle. FIG. 11 shows the various parts in the home position of ink tray 34 (100% or 0% of the cycle), and FIG. 17 shows the various parts at the inking position of ink tray 34 when ink tray 34 is at its maximum height (about 30% of the cycle) and tamped against printing device 38. A time is indicated on each figure corresponding to times on the ordinate axis in FIGS. 9 and 10. A Cartesian coordinate system is referenced in the upper part of FIGS. 11–17 with the ordinate axis 175 representing the horizontal or "x" position of ink tray 34 and the coordinate axis 179 representing the vertical or "y" position of ink tray 34, with the origin of the coordinate system designated 183. The links and rollers (followers) are designated in FIG. 11 with respect to the axis along which they control movement. Diametric line 90 through the circle representing cam wheel 88 and diametric line 93 through the circle representing shaft 93 of motor 85 indicate in FIGS. 11–17 rotational relationship of cam wheel 88 and motor shaft 93 and the positional relationship of the various links and rollers at the indicated times in the cycle. Ink pad 36 also moves along the x-axis at the same time it is rising at the last 0.060 inch of vertical rise (total rise is 0.210) to provide a wiping action against the printing drive, which improves ink transfer. This is referred to in the drawings as "alpha-scrub". The alphascrub ratio is 4:1, that is; 0.015 inch x-motion for the 0.060 inch y-motion. Various references locations are represented by cross hatches.

Figure 18:
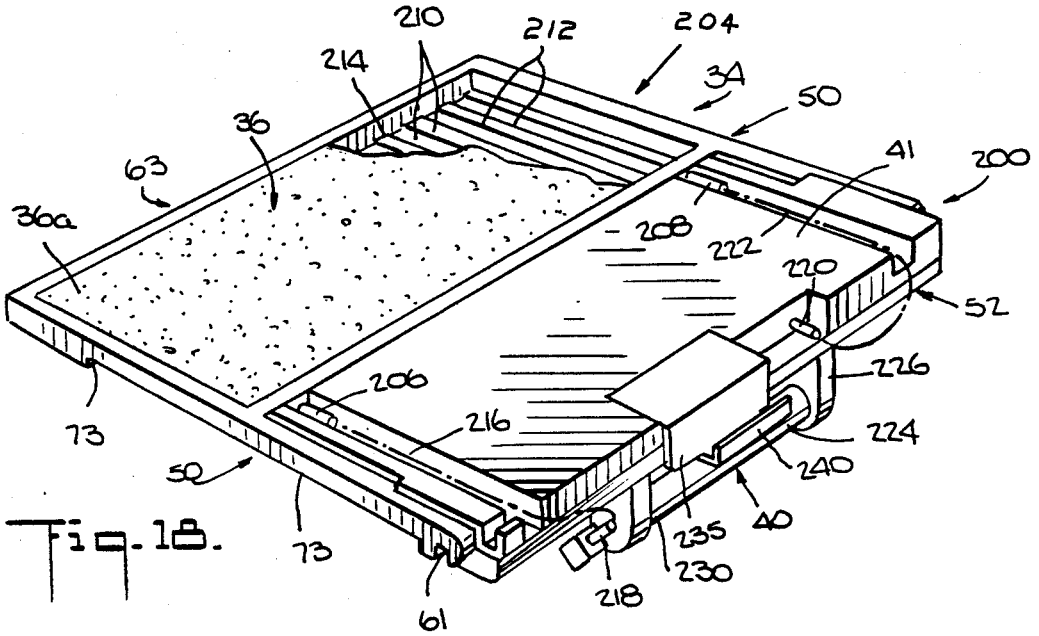
FIG. 18 is a perspective view of an ink pad, ink pad tray and pump according to the invention.
Figure 19:
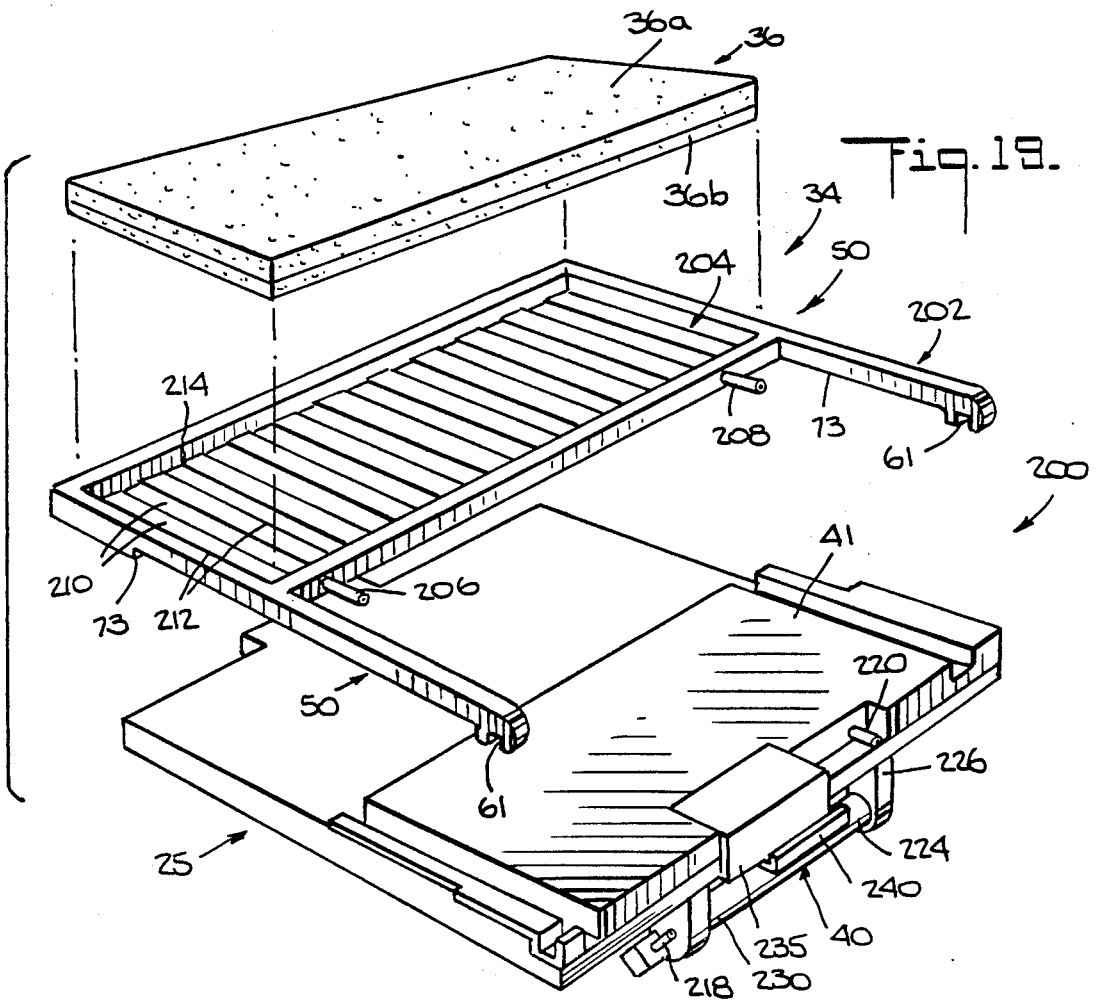
FIG. 19 is an exploded perspective view of the ink pad, ink pad tray and pump depicted in FIG. 18.

Referring to FIGS. 18 and 19, ink cartridge 200 includes ink reservoir 41 and ink tray 34 which holds ink pad 36 in an ink distribution chamber 204. Ink pad 36 is made of a resilient sorbent material which sorbs (i.e., absorbs) ink contained in ink distribution chamber 204. Ink pad 36 is compressed slightly during tamping thereof against inking device 38 to transfer ink thereto. Releasing of compression causes additional ink to be sorbed to the upper portion of ink pad 36. Preferably, ink pad 36 also sorbs ink through capillary action.

For use in a high speed mailing machine environment, ink tray 34 is constructed to transfer up to ink four times or more per second to the printing device 38, which imposes restraints on the amount of time in which ink must be sorbed by ink pad 36 and the amount of time in which ink must be transferred to printing device 38. Referring to FIGS. 9 and 10, each inking cycle is about 0.25 seconds (250 ms) including rest time, and is about 160 ms excluding rest time. Tamping takes up about 25 ms. Therefore, ink release to printing device 38 must take place within 25 ms, and a resupply of ink must be sorbed to the upper part of ink pad 36 in about 225 ms. Pump 40 must be compressed in about 80 ms and recover in about 80 ms. The design of ink tray 34 and pump 40 disclosed herein takes those restraints into consideration.

Ink pad 36 disclosed herein (FIGS. 18 and 19) includes a single layer or multi-layers. In the disclosed embodiment, two layers are shown, upper layer **36*a* and lower layer 36*b*. Upper layer 36*a* functions as a metering layer to release a metered amount of ink during tamping thereof against printing device 38, and lower layer 36*b* functions as a supply layer to the upper metering layer 36*a* to replenish ink released by the upper layer. Typically, upper layer 36*a* has a smaller average pore diameter than lower layer 36*b*, and ink transfer from ink distribution chamber 204 to lower layer 36*b*, and from lower layer 36*b* to upper layer 36*a* is by capillary action and negative internal pad pressures. During tamping, upper layer 36*a* is compressed slightly so that some ink transfer also occurs from lower layer 36*b* to upper layer 36*a* as a result, and upon release, of compression of upper layer 36*a*. The particular material used for ink pad 36 may depend upon the particular ink used. For example, when a dispersion ink is used, upper layer 36*a* and lower layer 36*b* may be a Scotfelt foam laminate (polyurethane) which consists of a firmness of 20 (upper) over 8 (lower), and when a solution ink is used, upper layer 36*a* may be in the so-called "Porex" media (sintered polyethylene), i.e., a polyethylene laminated with a heat-activated adhesive extending in a spider web pattern, and lower layer 36*b*** may be an olefinic material such as Neoprene.

Referring to FIGS. 18 and 19, ink distribution chamber 204 has an inlet 206, an optional outlet 208, a number of channels 210 formed therein by partitions 212 and a manifold 214 in communication with partitions 210. Ink pad 36 is supported on partitions 212 in communication with channels 210 and manifold 214 so as to sorb ink present in channels 210 and manifold 214. The height of partitions 212 is selected to properly deliver the required amount of ink at highest possible usage while printing. For the specific ink used in the mailing machine referred to above, the height is about 0.030 inch.

Although channels 210 are shown to extend parallel to each other and to be of equal size, they need not be, and other designs may be suitable for supplying ink to ink pad 36.

Tubing 216 represented schematically in FIG. 18 communicates the output 218 of pump 40 with the inlet 206 of ink distribution chamber 204. In some applications it is preferable to provide for the removal of excess ink to avoid overflow and splashing during high speed operation, and to insure adequate ink supply. Ink usage is variable depending on the printing area (with or without ad slogan; variation in the ad slogan design, etc.). For use of ink tray 34 in such applications, ink distribution chamber 204 may optionally have an outlet 208, and reservoir 41 may have an inlet 220. Ink distribution chamber outlet 208 and reservoir inlet 220 are communicated via tubing 222 (represented schematically), or may be blocked, depending on the particular application, etc. Reservoir 41 has an outlet (not shown in FIGS. 18 and 19) within support 226 in direct communication, without valving, etc., with the input 224 of pump 40.

Ink flow is as follows. Pump 40 injects ink into ink distribution chamber 204 from reservoir 41 via pump output 218, tubing 216 and ink distribution chamber inlet 206. Optionally, excess ink in ink distribution chamber 204 not sorbed by ink pad 36 is returned to reservoir 41 via ink distribution chamber outlet 208, tubing 222 and reservoir inlet 220. Outlet 208 is communicated with ink distribution chamber 204 at an appropriate height so that excess ink flows back to reservoir 41 primarily by gravity force and to some extent by the pumping action of pump 40. If desired, a second pump (not shown) may be used to pump excess ink back to reservoir 41.

Pump 40 (FIG. 21) comprises an elastic sleeve or tube 230 capable of repeatedly being compressed and recovering to its original shape. Within sleeve 230 are disposed an input valve 232 and an output valve 234. Valves 232 and 234 are one-way valves which permit liquid to flow from the reservoir (41 in FIG. 18) into sleeVe 230, and from sleeve 230 into ink pad distribution chamber 204. Ink reservoir 41 (FIGS. 18 and 19) includes a bearing surface 235 against which sleeve 230 is compressed by end 138 of link 130 (FIG. 2). Compression of sleeve 230 by link 130 closes valve 232 and opens valve 234, and expels ink from sleeve 230 through open valve 234. Upon release of the compression, a partial vacuum is created within sleeve 230 which closes valve 234 and opens valve 232, and which draws additional ink into sleeve 230. Valves 234 and 232 operate in the nature of ball valves, but are disposed entirely within sleeve 230. In the preferred embodiment valves 232 and 234 are duck bill valves which not only allow valves 232 and 234 to be placed entirely within sleeve 230, but also permit pump 40 to be operated at any attitude. In the embodiments illustrated in the drawings, pump 40 is disposed horizontally. In the presently preferred embodiment, the diameter of sleeve 230 is about $\frac{5}{8}$ inch and its length about 2 inches, and is compressed by about $\frac{1}{8}$ inch.

The particular application in which pump 40 will be used requires a consideration of the fluid to be pumped, the nature of the service environment, service life, cost, serviceability, etc. In the specific embodiments disclosed herein, sleeve 230 is made of an elastic material which is (a) non-reactive with the particular ink being used, (b) can withstand repeated compression cycles in the thousands to millions and recover to substantially its original shape to thereby perform the pumping action described above over the desired service life of the pump, and (c) can recover to substantially its original shape in a fraction of a second, more specifically within a time permitting at least four full pumping cycles per second. The wall thickness of sleeve 230 has an effect on service life and recovery time. A thicker wall thickness provides a faster recovery time, but also subjects sleeve 230 to more stress which reduces service life. For example, sleeve 40 may be made of an olefinic material such as Neoprene, silicone rubber, polyethylene or polypropylene which may have a preferred wall thickness of about 1/16 inch, and the duck bill valves may be made of olefinic material such as Neoprene (for ink capability). Similarly, other parts which come into contact with ink are made of a material which is not reactive with the particular ink used. Sleeve 230 may be connected to reservoir 41 by fitting the ends thereof tightly over conical fittings 236, 238 (FIG. 21), and sealing the sleeve to the fittings by means of an adhesive, heat shrinking, etc.

Referring to FIGS. 18 and !9, ink cartridge 200 (including ink tray 34) and ink pump 40 may be supplied as a disposable cartridge unit comprising ink reservoir 41, ink pad holder 202 including ink distribution chamber 204 and ink pad 36, and pump 40 Such a cartridge may be supplied tightly covered in foil or plastic to preserve product integrity during shipment, storage and handling, and ready for installation, which is facilitated by virtue of the snap-fit construction of ink tray 34 described above. Ink cartridge 200 includes a finger grasp 240 which may be engaged to un-snap ink cartridge 200 from and snap ink cartridge 200 into inker module 25. If desired individual parts of ink tray 34 and ink cartridge 200 may be replaced, although replacement as a unit is preferred.

Figure 20:
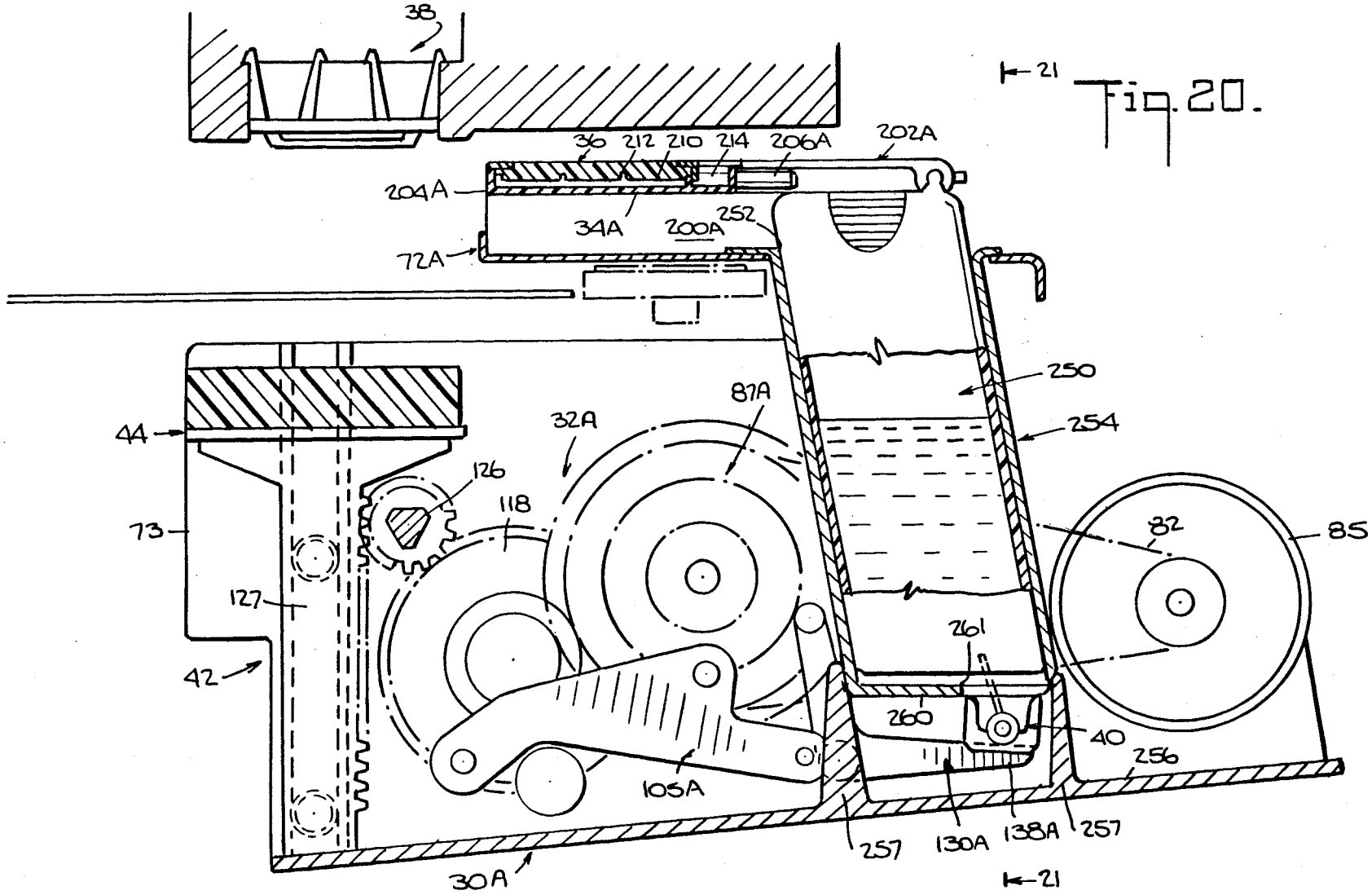
FIG. 20 is a side sectional view of another embodiment of an ink pad, ink pad tray and pump, this embodiment including an ink reservoir, and this figure also showing portions of the ink tray drive which also actuate the pump.
Figure 21:
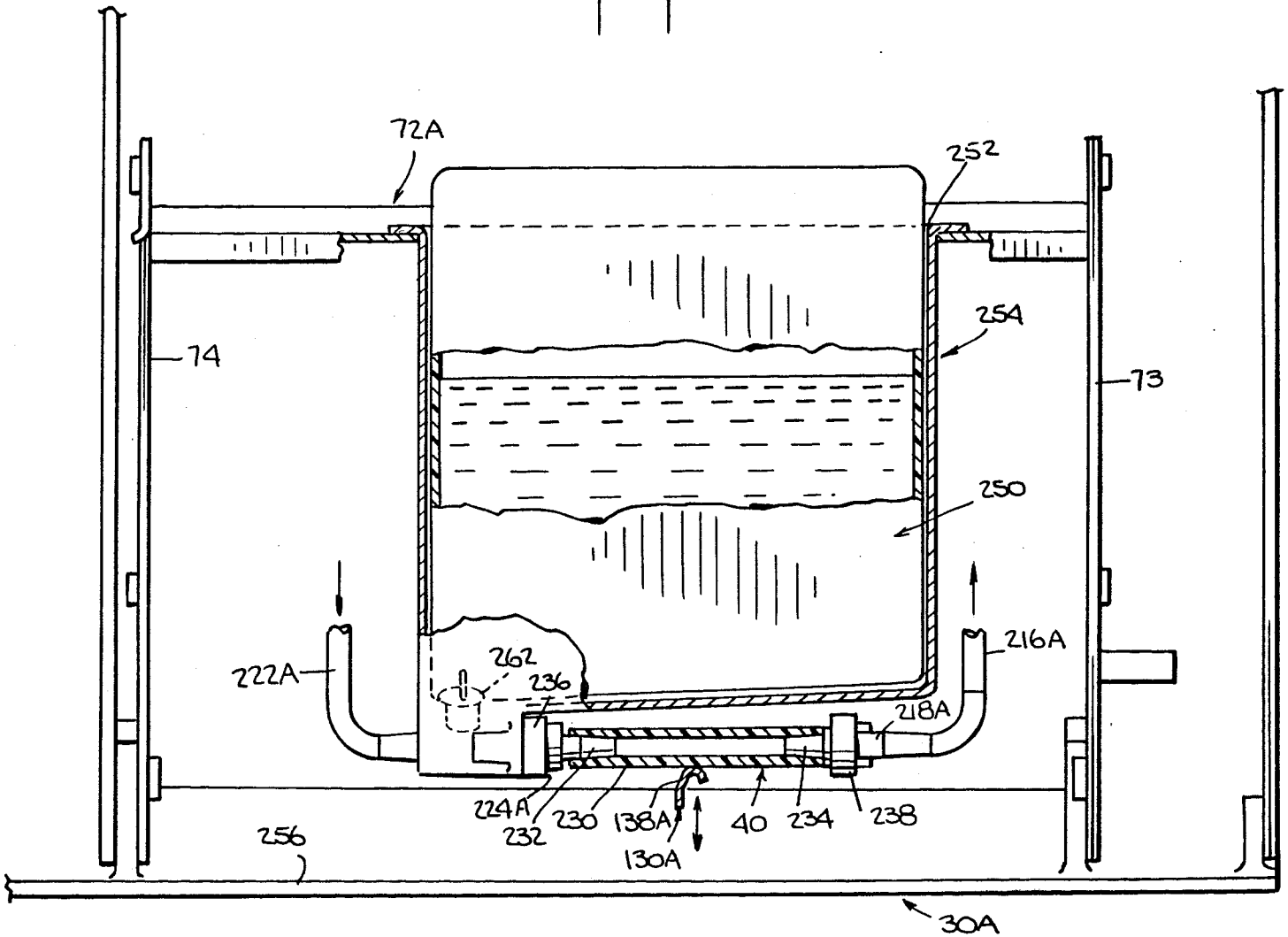
FIG. 21 is a sectional view of the reservoir and pump depicted in FIG. 20 taken along line 21—21 of FIG. 20.

FIGS. 20 and 21 depict an alternate embodiment in which ink cartridge 200 includes ink tray 34A, and ink pad holder 202A including ink distribution chamber 204A. Ink cartridge 200 does not include an ink reservoir, rather a separate larger reservoir 250 is provided. Ink pad holder 202A is constructed and mounted similar to ink pad holder 202, and ink distribution chamber 204A is similar to ink distribution chamber 204. Platform 72A is constructed and mounted similar to platform 72 except that reservoir 250 is disposed transversely to the plane of platform 72A, i.e., vertically, protruding through hole 252 thereof. Ink pad holder 202A moves relative to platform 72A as generally described for ink tray 34 and platform 72. Ink reservoir 250 is received in receptacle 254 mounted to the bottom 256 of chassis 30A by flanges 257. With tray 34A removed, reservoir 250 is simply dropped in or lifted out of receptacle 254. Pump 40 is affixed to the bottom 260 of reservoir 250 projecting through hole 261 of receptacle 254. Pump 40 extends horizontally as in the embodiment of FIGS. 18 and 19.

Drive 32A includes a link 130A supported to be cammed by cam wheel 87A similar to link 130 and cam wheel 87 so that its end 138A compresses sleeve 230 of pump 40, as described above for drive 32, link 130 and cam wheel 187. The output of pump 40 is communicated with the inlet 206A of ink distribution chamber 204A by tubing 216A, and the outlet of ink distribution chamber 204A is communicated with port 262 of reservoir 250 by tubing 222A. Port 262 communicates with the input 224 of pump 40.

Ink tray 34A and reservoir 250 and pump 40 operate to pump ink from reservoir 250 to ink distribution chamber 204A as described for the embodiment depicted in FIGS. 18 and 19, except that excess from ink distribution chamber 204A tends to be recirculated rather than returned to reservoir 250.

In the embodiment depicted in FIGS. 20 and 21, ink reservoir 250 and pump 40 are replaceable separately from ink tray 34A. Tray 34A may easily be replaced, as described for tray 34, by a new tray., After un-snapping tray 34A, and disconnecting tubing 216A and 222A, reservoir 250 is exposed and may easily be lifted out of receptacle 254 for removal and replacement, and thereafter replaced by connecting tubing 216A and 222A, and dropping reservoir 250 back into receptacle 254. If necessary, receptacle 254, reservoir 250 and pump 40 may be replaced by a new unit.

For those embodiments which include an ink pump 40, it may be necessary to initialize the system each time an ink tray is changed to pump a predetermined amount of ink into the ink distribution chamber 204, 204A before commencing actual printing operations.

The control system described in application Ser. No. (attorney docket C-444), referenced above, may be used to accomplish and synchronize the foregoing operation of drives 32 (32A) and 42, and pump 40.

Certain changes and modifications of the embodiments of the invention herein disclosed will be readily apparent to those of skill in the art. Moreover, uses of the invention other than in mailing apparatus will also be readily apparent to those of skill in the art. It is the applicants' intention to cover by the claims all such uses and all those changes and modifications which could be made to the embodiments of the invention herein chosen for the purposes of disclosure which do not depart from the spirit and scope of the invention.

We claim:

1. A drive for sequentially moving an ink pad along first and second directions transverse to each other from a home position to an inking position, comprising:

An ink pad;

a first link member coupled at a first end thereof to said ink pad;

a second link member coupled at a first end thereof to said ink pad;

camming means having first and second camming surfaces for providing cammed displacement;

an ink reservoir;

an ink pump means for pumping ink from said reservoir to said ink pad in response to movement of said camming means;

said first ink member having at a second end thereof a cam follower surface;

said second link member having at a second end thereof a cam follower surface;

said cam follower surface of said first link slidably engages said first camming surface and is cammed thereby to move said first link member upon movement of said camming means;

said cam follower surface of said second link slidably engages said second camming surface and is cammed thereby to move said second link member upon movement of said camming means;

said first link member being configured and coupled to said ink pad and said second link member being configured and coupled to said ink pad, and said cam surfaces being configured such that a given movement of said camming means causes said first link member to move said ink pad a given distance in said first direction, and a given movement of said camming means causes said second link member to move said ink pad a given distance in said second direction to said inking position.

2. The drive of claim 1 wherein said camming means comprises a plurality of first camming surfaces and a plurality of second camming surfaces, and said first link member comprising a plurality of first links extending spaced from each other and parallel to each other coupled at respective first ends thereof to said ink pad at spaced locations thereof and engaging respective first camming surfaces at respective second ends thereof, said second link member comprising a plurality of second links extending spaced from each other and parallel to each other coupled to said ink pad at spaced locations thereof and engaging respective second camming surfaces at respective second ends thereof, said first and second links and said camming means moving said ink pad in said directions.

3. The drive of claim 2 wherein said first and second links are coupled to said ink pad to support said ink pad generally horizontally and move said ink pad generally horizontally, and generally vertically from said home position to said inking position.

4. The drive of claim 3 including a platform-type support, said second links being pivotally coupled to said support between said first and second ends of said second links, and said second links movably supporting said ink pad above said support, said first and second links moving said ink pad horizontally relative to said support and vertically relative to said support in moving said ink pad from said home position to said inking position.

5. The drive of claim 1 wherein said camming means comprises a cam wheel having said first and said second camming surfaces and means for rotating said cam wheel over a given angle to cause said first link member to move said ink pad said given distance in said first direction and for rotating said cam wheel over a given angle to cause said second link member to move said ink pad said given distance in said second direction.

6. The drive of claim 4 wherein said camming means comprises a plurality of cam wheels each having a said first and a said second camming surface and means for rotating said cam wheels over a given angle to cause said first links to move said ink pad said given distance horizontally and over a given angle to cause said second links to move said ink pad said given distance vertically.

7. The drive of claim 1 wherein said ink pump means for pumping ink from a reservoir to said ink pad comprises a deformable chamber and valving such that upon compression of said chamber, ink therein is expelled for delivery to said ink pad and upon release of said compression ink is drawn therein from said reservoir, a third link member having structure at a first end thereof configured to compress said chamber, said third link member having at a second end thereof a cam follower surface, said camming means having a third camming surface, said third link member being supported such that its cam follower surface engages said third camming surface and is cammed thereby to move said third link member and compress said chamber upon a given movement of said camming means.

8. The drive of claim 7 wherein said third camming surface is configured such that said structure at said first end of said third link member compresses said chamber and releases compression thereof once each time that said ink pad is moved from said home position to said inking position and back again.

9. The drive of claim 8 wherein said camming means comprises a cam wheel having said first, said second and said third camming surfaces and means for rotating said cam wheel over a given angle to cause said first link member to move said ink pad said given distance in said first direction and over a given angle to cause said second link member to move said ink pad said given distance in said second direction and over a given angle to cause said third link member to compress said pump.

* * * * *